United States Patent [19]

Doi et al.

[11] Patent Number: 4,957,774

[45] Date of Patent: Sep. 18, 1990

[54] METHOD OF HEAT-FIXING TONER IMAGE

[75] Inventors: Shinji Doi; Satoshi Yoshida, both of Kawasaki; Satoshi Matsunaga, Tokyo; Hiroaki Kawakami, Kawasaki; Takashige Kasuya, Tokyo; Yasuhide Goseki; Yusuke Karami, both of Yokohama, all of Japan

[73] Assignee: Canon Kabushiki Kaisha, Tokyo, Japan

[21] Appl. No.: 450,256

[22] Filed: Dec. 13, 1989

[30] Foreign Application Priority Data

| | | | |
|---|---|---|---|
| Dec. 14, 1988 | [JP] | Japan | 63-316758 |
| Dec. 15, 1988 | [JP] | Japan | 63-315021 |
| Dec. 15, 1988 | [JP] | Japan | 63-316834 |
| Dec. 15, 1988 | [JP] | Japan | 63-316836 |
| Dec. 16, 1988 | [JP] | Japan | 63-316133 |
| Dec. 16, 1988 | [JP] | Japan | 63-316139 |
| Dec. 21, 1988 | [JP] | Japan | 63-324502 |

[51] Int. Cl.[5] ..... H01F 10/02; B05D 3/02

[52] U.S. Cl. ..... 427/45.1; 427/14.1; 427/128; 427/256; 427/370; 427/385.5

[58] Field of Search ..... 427/45.1, 14.1, 128, 427/256, 370, 385.5

*Primary Examiner*—Bernard Pianalto

*Attorney, Agent, or Firm*—Fitzpatrick, Cella, Harper & Scinto

[57] ABSTRACT

A method of heat-fixing a visible image of toner to a recording medium comprises applying a toner image onto the recording medium, wherein the toner to form said toner image or the resin component of the toner has the properties such that the melt viscosity $\eta'$ measured by an overhead-type flow tester is from $10^3$ to $10^6$ poise at a temperature within the temperature range of from 120° C. to 150° C., and the absolute value of the inclination of a graph is not more than 0.50 ln (poise)/°C. when the natural logarithms $\ln\eta$ of the melt viscosities at 120° C. and 150° C. are plotted with respect to the temperatures; and heat-fixing the toner image retained on the recording medium to the recording medium by use of a heater element as stationarily supported and a pressure member that brings said recording medium into close contact with said heater element through a film interposed between them.

39 Claims, 8 Drawing Sheets

METHOD OF HEAT-FIXING TONER IMAGE

BACKGROUND OF THE INVENTION

1. Field of the invention

The present invention relates to a method of fixing to a recording medium a visible image formed with a toner, as in image forming processes such as electrophotography, electrostatic printing, and magnetic recording.

2. Related Background Art

As a method of fixing a visible image of toner onto a recording medium, a heat-roll fixing system is widely used, in which a recording medium retaining thereon a toner visible image having not been fixed is heated while it is held and carried between a heat roller maintained at a given temperature and a pressure roller having an elastic layer and coming into pressure contact with the heat roller.

As another method, a belt fixing system is known, as disclosed in U.S. Pat. No. 3,578,797.

The above conventional heat-roll fixing, however, has the following disadvantages:

(1) A long waiting time is required until the heat roller reaches the given temperature.

(2) The heat roller must be maintained at an optimum temperature in order to prevent poor fixing caused by the variations of the heat-roller temperature that may occur when the recording medium is passed or because of other external factors, and also to prevent the offset phenomenon of toner on the heat roller. This makes it necessary to make large the heat capacity of the heat roller or a heater element, which requires a large electric power.

(3) When the recording medium is passed over the heat roller and delivered out, the recording medium and the toner on the recording medium are slowly cooled, resulting in a state of high adhesion of the toner. Thus, conjointly with the curvature of the roller also, there may often occur offset, or paper jam caused by the rolling-up of the recording medium.

(4) A protective member must be provided in order to prevent direct touch to the high-temperature heat roller.

On the other hand, the above problems (1) and (2) of the heat-roll fixing are not fundamentally solved also in the belt fixing system disclosed in U.S. Pat. No. 3,578,797.

Japanese Patent Application No. 147884/1987 (corresponding to European Publication No. 0295,901), as having already been proposed by the present applicant, proposes an image forming apparatus with a shorter waiting period and a low power consumption, comprising a fixing unit in which a toner visible image is heated through a movable heat-resistant sheet by means of a heating element having a low heat capacity, pulsewise generating heat by applying electric power, and thus fixed to a recording medium. Japanese Patent Application No. 63-12069 (corresponding to European Publication No. 0295,901), as also having already been proposed by the present applicant, proposes a fixing unit for heat-fixing a toner visible image on a recording medium through a heat-resistant sheet, wherein said heat-resistant sheet comprises a heat-resistant layer and a release layer or a low-resistant layer, thereby effectively preventing the offset phenomenon.

In addition to the fixing unit mentioned above, properties of the toner are greatly concerned in realizing a fixing method that requires only a short waiting period and a low power consumption while achieving the excellent performance of fixing a toner visible image to a recording medium and the prevention of the offset phenomenon.

SUMMARY OF THE INVENTION

An object of the present invention is to provide a novel heat fixing method that has solved the problems as discussed above, requires substantially no, or only a very short, waiting period and a low power consumption, can prevent the offset phenomenon from occurring, and can achieve good fixing of a toner image to a recording medium.

Another object of the present invention is to provide a heat fixing method that employs no high-temperature revolving roller, thus requiring no heat-resistant special bearing.

Still another object of the present invention is to provide a heat fixing method using a fixing unit so constituted as to prevent direct touch to high-temperature parts, thus achieving higher safety or requiring no protective members.

The above objects of the present invention can be attained by a method of heat-fixing a visible image of toner to a recording medium, comprising applying a toner image onto the recording medium, wherein;

the toner to form said toner image has the properties that the melt viscosity $\eta'$ measured by an overhead-type flow tester iS from $10^3$ to $10^6$ poise at a temperature within the temperature range of from 120° C. to 150° C., and an absolute value of the inclination of a graph is not more than 0.50 ln (poise)/°C. when the natural logarithms $\ln\eta'$ of the melt viscosity at 120° C. and 150° C. are plotted with respect to the temperatures: and heat-fixing to the recording medium the toner image retained on the recording medium, using a heater element stationarily supported and a pressure member that brings said recording medium into close contact with said heater element through a film interposed between them.

BRIEF DESCRIPTION OF THE DRAWINGS

In the accompanying drawings.

show inclinations of smaller absolute values than those within the temperature range of from 120° C. to 150° C.

Figure 6:
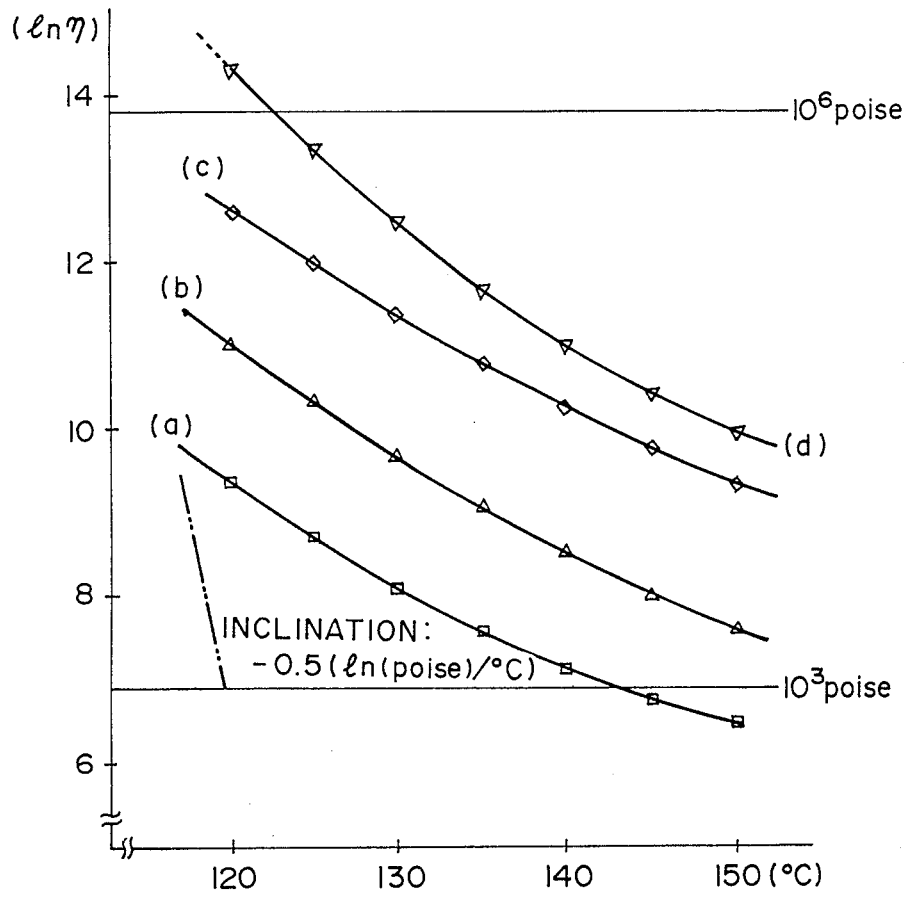

FIG. 6 is an example of the graphic representation to show the melt viscosity characteristics at 120° C. to 150° C., of a binder resin comprising a polymer composed of one or more kinds of $\alpha,\beta$-unsaturated ethylenic monomers in a toner used in the present invention. The logarithms $\ln\eta$ of the melt viscosity of binder resin is plotted as ordinate, and temperature as abscissa. The two-dot chain line in FIG. 6 shows the inclination −0.50 ln (poise)/°C. of this graph.

Figure 7:
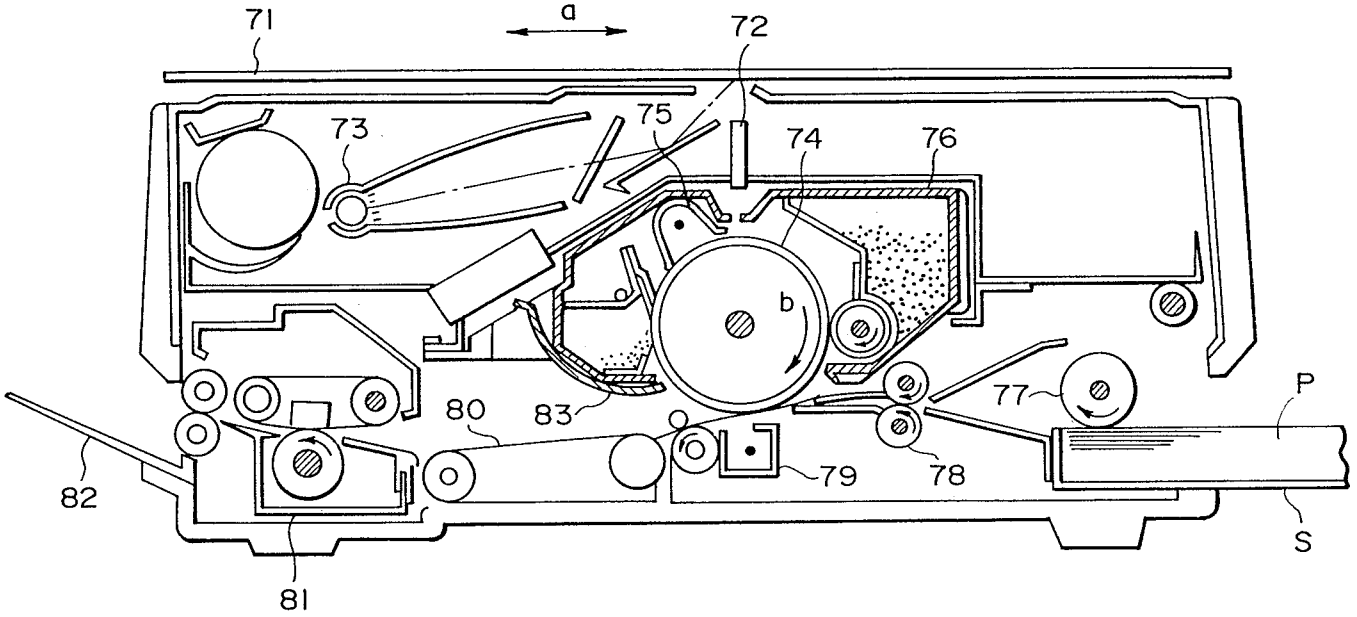

FIG. 7 is a schematic cross section of an image forming apparatus equipped with the fixing unit carrying out the fixing method of the present invention.

Figure 1:
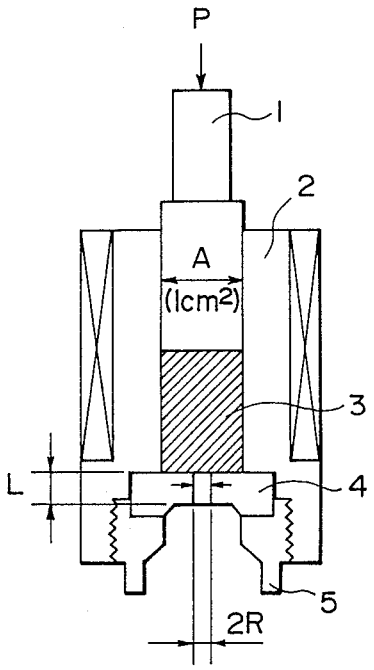
FIG. 1 is a schematic cross section of an overhead-type flow tester used for measuring the melt viscosity of toner or binder resin.
Figure 2:
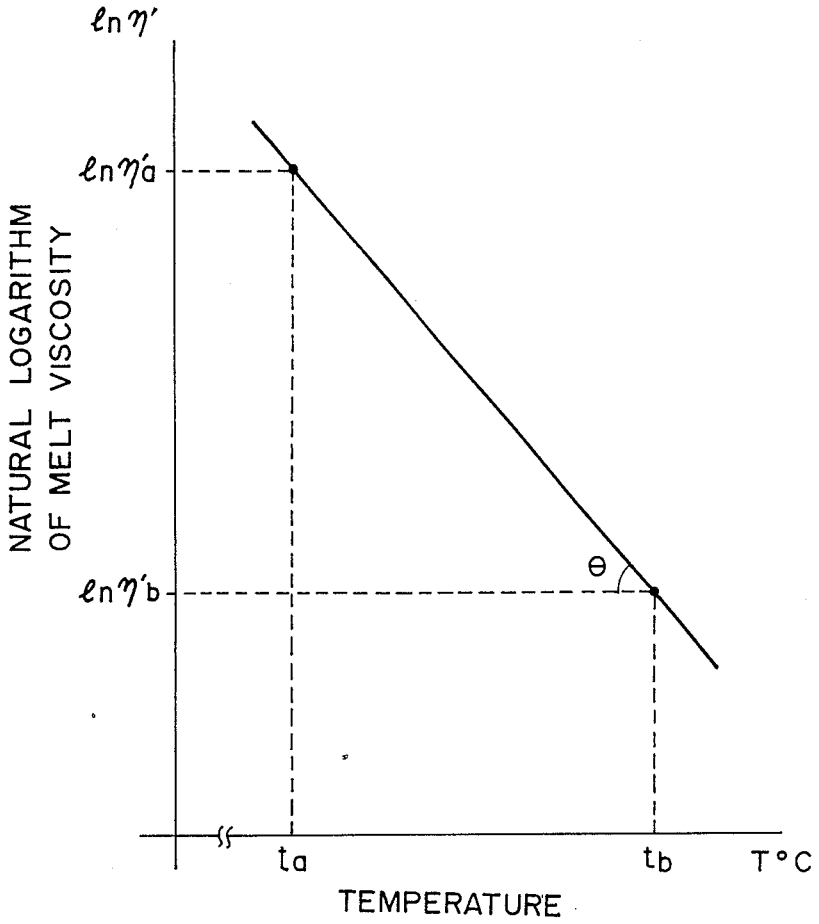
FIG. 2 is a graphic representation concerning the inclination of the natural logarithms of the viscosity of toner or binder resin, with respect to temperature.
Figures 1, 8:
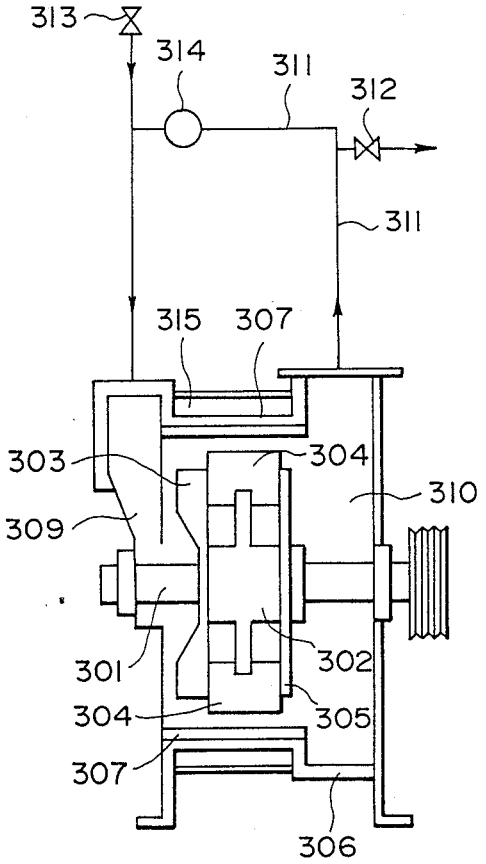
Figures 2, 8:
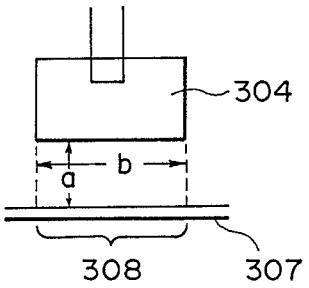

FIG. 8-1 schematically illustrates an example of an apparatus for making particles fast on core particles, and FIG. 8-2 is a partial enlarged view of the apparatus shown in FIG. 8-1.

DETAILED DESCRIPTION OF THE PREFERRED EMBODIMENTS

The fixing apparatus used in the heat-fixing method of the present invention will be described below.

In the present invention, the heater element has a smaller heat capacity than conventional heat rolls, and has a linear heating part. The heating part may preferably be made to have a maximum temperature of from 100° to 300° C.

A film is interposed between the heater element and the pressure member, and may preferably comprise a heat-resistant sheet of from 1 to 100 μm in thickness. Heat-resistant sheets that can be used therefor include sheets of polymers having high heat-resistance, such as polyester, PET (polyethylene terephthalate), PFA (a tetrafluoroethylene/perfluoroalkyl vinyl ether copolymer), PTFE (polytetrafluoroethylene), polyimide, and polyamide, sheets of metals such as aluminum, and laminate sheets comprised of a metal sheet and a polymer sheet.

In a preferred constitution of the film, these heat-resistant sheets have a release layer and/or a low-resistant layer.

A preferred embodiment of the present invention will be described below with reference to the accompanying drawings. This, however, by no means limits the present invention.

Figure 4A:
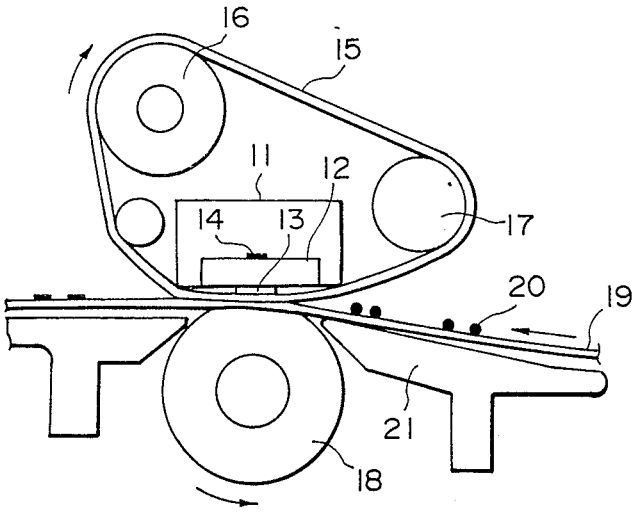
FIG. 4*a* is a schematic cross section of a fixing unit used for carrying out the fixing method of the present invention.

FIG. 4A illustrates the structure of the fixing unit in the present embodiment.

The numeral 11 denotes a low heat capacitance linear heater element stationarily supported in the device. An example thereof comprises an alumina substrate 12 of 1.0 mm in thickness, 10 mm in width and 240 mm in longitudinal length and a resistance material 13 coated thereon with a width of 1.0 mm, which is electrified from the both ends in the longitudinal direction. The electricity is applied under variations of pulse widths of the pulses corresponding with the desired temperatures and energy emission quantities which are controlled by a temperature sensor 14, in the pulse-like waveform with a period of 20 msec of DC 100V. The pulse widths range approximately from 0.5 msec to 5 msec. In contact with the heater element 11 the energy and temperature of which have been controlled in this way, a fixing film 15 moves in the direction of the arrow shown in FIG. 4A. An example of this fixing film includes an endless film comprising a heat-resistant sheet of 20 μm thick (comprising, for example, polyimide, polyetherimide, PES, or PFA, and a fluorine resin such as PTFE or PFA at least on the side coming into contact with the image) and a release layer provided thereon by coating to have a thickness of 10 μm in which a conductive material is added. In general, the total thickness of the film may preferably be less than 100 μm, and more preferably less than 40 μm. The film is moved in the direction of the arrow in a wrinkle-free state by the action of drive and tension between a drive roller 16 and a follower roller 17.

The numeral 18 denotes a pressure roller having on its surface an elastic layer of rubber with good release properties as exemplified by silicone rubber. This pressure roller is pressed against the heater element at a total pressure of 4 to 20 kg through the film interposed between them and is rotated in pressure contact with the film. Toner 20 having not been fixed (hereinafter "unfixed toner") on a transferring medium 19 is led to the fixing zone by means of an inlet guide 21. A fixed image is thus obtained by the heating described above.

Figure 4B:
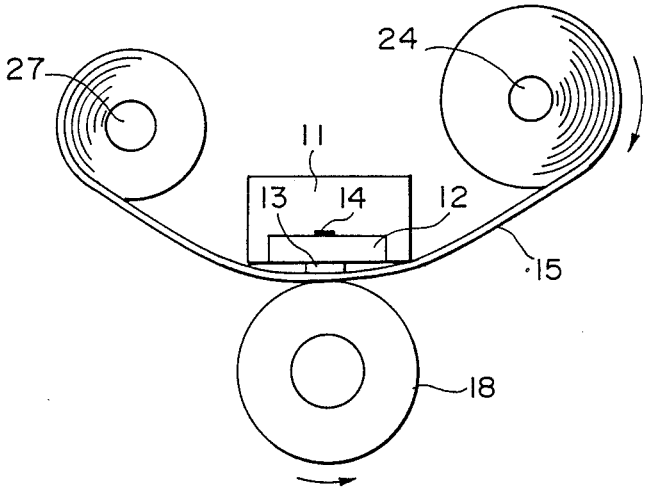
FIG. 4*b* is a schematic cross section of a fixing unit used for working the fixing method according to another embodiment of the present invention.

The above has been described with reference to the endless belt. As FIG. 4B shows, however, a sheet-feeding shaft 24 and a wind-up shaft 27 may also be used, where the fixing film may not be endless.

The image forming apparatus includes apparatus that form an image by the use of a toner, as exemplified by copying machines, printers, and facsimile recorders, to which the present fixing unit can be applied.

When the temperature detected by the temperature sensor 14 in the low heat capacity linear heater element is $T_1$, the surface temperature $T_2$ of the film 15 opposed to the resistance material 13 is about 10° to 30° C. lower than $T_1$. The surface temperature $T_3$ of the film on the part at which the film 15 is peeled from the toner-fixed face is substantially equal to the above temperature $T_2$.

The toner used in the fixing method of the present invention will be described below.

In the fixing method of the present invention, the toner or the resin component of the toner has the properties that the melt viscosity $\eta'$ measured by an overhead-type flow tester is from $10^3$ to $10^6$ poise at a temperature within the range of from 120° C. to 150° C., and an absolute value of the inclination of a graph is not more than 0.50 ln (poise)/°C. when the natural logarithms $\ln\eta'$ of the melt viscosity at 120° C. and 150° C. are plotted with respect to the temperatures.

The toner in the present invention includes a capsule toner formed of a core particle and a shell that covers the core particle.

In the present invention, as the resin component that constitutes the toner are preferably used cross-linked polyester resins, or cross-linked polymers or copolymers of $\alpha,\beta$-ethylenically unsaturated monomers.

Preferred examples of the cross-linked polyester resins will be described below.

The cross-linked polyester resins may preferably include cross-linked polyester resins comprised of;

(A) etherified bisphenols;

(B) not less than 30 mol % of aromatic dicarboxylic acid, in all acid components;

(C) 5 to 40% by weight of alkenyl-substituted dicarboxylic acids and/or alkyl-substituted dicarboxylic acids, based on the total amount of acids; and (D) polycarboxylic acids with three or more carboxylic groups and/or polyols with three or more hydroxyl groups; and wherein the melt viscosity $\eta'$ measured by an overhead-type flow tester is from $10^3$ to $10^6$ poise at a temperature within the range of from 120° C. to 150° C., and an absolute value of the inclination of a graph is not more than 0.50 ln (poise)/°C. when the natural logarithms $\ln\eta'$ of the melt viscosity at 120° C. and 150° C. are plotted with respect to the temperatures.

In the heat-fixing method of the present invention, the toner can be heat-fixed to the recording medium at a lower power consumption when a toner is used which employs as the binder resin a polyester resin having a basic skeleton comprised of etherified bisphenols and aromatic dicarboxylic acids, where the polymer skeleton are made to have network structures by the polycarboxylic acids with three or more carboxylic groups and/or polyols with three or more hydroxyl groups, and the alkenyl-substituted dicarboxylic acids and/or alkyl-substituted dicarboxylic acids are introduced into the skeleton as soft segments.

An amount of the above soft segments which is less than 5% by weight based on the total amount of acids may result in an increase in the power consumption required for the heat fixing. On the other hand, an amount exceeding 40% by weight may make stronger the agglomeration force between toner particles to lower storage stability. The polycarboxylic acids, the component by which the polymer skeletons are made to have network structure, is preferably contained in the polyester in an amount of from 5 to 30% by weight. The polyols is preferably contained in an amount of not more than 5% by weight.

The total amount of the polycarboxylic acids and polyols which are cross-linking components, preferably, is not more than 40% by weight. An amount more than 40% by weight may result in a lowering of the moisture resistance of the toner and make charge characteristics unstable because of environmental variations, tending to bring about defects at the time an image is formed (at the time of development or transfer) before the fixing. It may further result in an increase in the cost for the pulverization in the step of preparing the toner, requiring a larger energy for achieving the heat fixing of the toner.

On the other hand, it is preferable that the total amount of the polycarboxylic acids is not less than 10% by weight in the polyester. An amount less than that may make the tendency of excessive fusion of toner begin to appear in the step of heat fixing. An amount less than 5% by weight is liable to cause the penetration into the recording medium such as transfer paper, the bleed-through, or the bleeding of image because of the spread of fused toner.

In view of the charge characteristics, durability, transfer performance and electrophotographic performance of the toner, among the main components of the cross-linked polyester, it is preferred for the aromatic dicarboxylic acids as the acid component to be contained in the amount of not less than 30 mol %, more preferably not less than 40 mol %, in all the acid components, and for the etherified bisphenols as the alcohol component to be contained in the amount of not less than 80 mol %, more preferably not less than 90 mol %, in all the alcohol components.

The toner can be fixed on the recording medium at a lower power consumption without causing any offset to the film, when as described above, the melt viscosity $\eta'$ of the polyester resin measured by an overhead-type flow tester is from $10^3$ to $10^6$ poise at a temperature within the range of from 120° C. to 150° C., and an absolute value of the inclination of a graph is not more than 0.50 ln (poise)/°C. when the natural logarithms $\ln\eta'$ of the melt viscosity at 120° C. and 150° C. are plotted with respect to the temperatures.

The viscosity can be measured using an overhead-type flow tester as illustrated in FIG. 1 (Shimazu Flow Tester CFT-500 Type), where, in the first place, about 1.5 g of a sample 3 molded using a pressure molder is extruded from a nozzle 4 of 1 mm in diameter and 1 mm in length under application of a load of 19 kgf at a given temperature using a plunger 1, so that the fall quantity of the plunger (flow rate) on the flow tester is measured. This flow rate is measured at each temperature (with the interval of 5° C. within the temperature range of at least from 120° C. to 150° C.). The apparent viscosity $\eta'$ can be calculated from the resulting values, based on the following equation.

$$\eta' = \frac{TW'}{DW'} = \frac{\pi PR^4}{8LQ} \text{ (poise)}$$

wherein;

$$TW' = \frac{PR}{2L} \text{ (dyne/cm}^2\text{)}$$

$$DW' = \frac{4Q}{\pi R^3} \text{ (sec}^{-1}\text{)}$$

$\eta'$: Apparent viscosity (poise)
TW': Apparent slide reaction on tube wall (dyne/cm$^2$)
DW': Apparent slide speed on tube wall (1/sec)
Q: Rate of flow-out (cm$^3$/sec=ml/sec)
P: Extrusion pressure (dyne/cm$^2$) [10 kgf=$980\times10^4$ dyne]
R: Radius of nozzle (cm)
L: Length of nozzle (cm)

A melt viscosity more than $10^6$ poise at 120° C. to 150° C., of the binder resin polyester used in the toner may result in an increase in power consumption even in the heat-fixing method of the present invention, bringing about the disadvantages that fixing is made poor or quick start is made difficult. If the total amount of the cross-linking (network-structure forming) components in the polyester of the present invention become more than 35% by weight, the melt viscosity may sometimes become more than $10^6$ poise.

On the other hand, a melt viscosity less than $10^3$ poise at 120° C. to 150° C. may make conspicuous the disadvantages (such as bleed-through, and bleeding of image) caused by the excessive fusion of toner.

If the total amount of the cross-linking (network-structure forming) components in the polyester of the present invention become less than 5% by weight, the melt viscosity may sometimes become less than $10^3$ poise even at 120° C. The absolute values of the inclination to temperature of the natural logarithms $\ln\eta'$ of the melt viscosity $\eta'$ at 120° C. and 150° C. reflect the sensitiveness of the viscosity of the polyester resin of the present invention to the temperature variations. A value more than 0.50 ln (poise)/°C. is liable to cause the offset to the recording medium such as a film, moreover bringing about excessive gloss of fixed images to lower the image quality level.

The absolute value of this inclination also depends on the amount of the cross-linking components and the amount of the soft segments in the polyester resin of the present invention, and the proportion thereof, and use of them in the amounts within the range of what is claimed in the present invention can achieve the fixing performance, offset resistance, and image forming performance in a good state in the heat-fixing method of the present invention.

In the present invention, the "inclination" of the viscosity is a value obtained when, as shown in FIG. 2, a measuring point at $t_a$°C. and a measuring point at $t_b$°C. in the graph are connected by a solid line and its "inclination" is calculated from the equation:

$$\tan\theta = \frac{\ln\eta a' - \ln\eta b'}{t_b - t_a}$$

This is used in approximation as the "inclination" of a slope, wherein $\ln\eta a'$ and $\ln\eta b'$ represent values corresponding to the natural logarithm of the viscosity at $t_a$°C., and $t_b$°C., respectively.

Those which can be used as the etherified bisphenols, i.e., the component materials of the polyester resin serving as the binder resin, include polyoxystyrene(6)-2,2-bis(4-hydroxyphenyl)propane, polyhydroxybutylene(2)-2,2-bis(4-hydroxyphenyl) propane, polyoxyethylene(3)-2,2-bis(4-hydroxyphenyl)propane, polyoxypropylene(3)-bis(4-hydroxyphenyl)thioether, polyoxyethylene(2)-2,6-dichloro-4-hydroxyphenyl, 2',3',6'-trichloro-4'-hydroxyphenylmethane, polyoxypropylene(3)-2-bromo-4-hydroxyphenyl, 4-hydroxyphenyl ether, polyoxyethylene(2,5)-p,p-bisphenol, polyoxybutylene(4)-bis(4-hydroxyphenyl)ketone, polyoxystyrene(7)-bis(4-hydroxyphenyl)ether, polyoxypentylene(3)-2,2-bis(2,6-diiodo-4-hydroxyphenyl)propane, and polyoxypropylene(2,2)-2,2-bis(4-hydroxyphenyl)-propane.

A group of the etherified bisphenols includes etherified bisphenols. Preferred group of the etherified bisphenols includes those formed into ethoxy or propoxy, having 2 or 3 mols of oxyethylene or oxypropylene per mole of bisphenol, and having a propylene or sulfone group. Examples of this group are polyoxyethylene(2,5)-bis(2,6-dibromo-4-hydroxyphenyl)sulfone, polyoxypropylene(3)-2,2-bis(2,6-difluoro-4-hydroxyphenyl)propane, and polyoxyethylene(1,5)-polyoxypropylene(1,0)-bis(4-hydroxyphenyl)sulfone.

Another preferred group of the etherified bisphenols includes polyoxyethylene-2,2'-bis(4-hydroxyphenyl)-propane, and polyoxyethylene- or polyoxypropylene-2,2-bis(4-hydroxy-2,6-dichlorophenyl)propane (the number of the oxyalkylene unit is 2.1 to 1.5 per mole of bisphenol).

The aromatic dicarboxylic acids, the component materials of the polyester resin of the present invention, include terephthalic acid, isophthalic acid, phthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, and 1,2-diphenoxyethane-p,p'-dicarboxylic acid. Acids other than these include maleic acid, fumaric acid, glutaric acid, cyclohexanecarboxylic acid, succinic acid, malonic acid, adipic acid, mesaconic acid, citraconic acid, sebacic acid, and anhydrides of these acids.

The alkenyl-substituted dicarboxylic acids or alkyl-substituted dicarboxylic acids, the component materials of the polyester resin of the present invention, include maleic acid, fumaric acid, adipic acid, succinic acid, glutaric acid, sebacic acid, azelaic acid substituted by an alkenyl group or an elkyl group having 6 to 18 carbon atoms, and anhydrides or esters thereof. Particularly preferred are n-dodecenyl succinate, isododecenyl succinate, n-dodecyl succinate, isododecyl succinate, isooctyl succinate, n-octyl succinate, and n-butyl succinate.

The polycarboxylic acids with three or more carboxylic acids, the component materials of the polyester resin of the present invention, include trimellitic acid, pyromellitic acid, cyclohexanetricarboxylic acid, 2,5,7-napnthalenetricarboxylic acid, 1,2,4-napnthalenetricarboxylic acid, 1,2,4-butanetricarboxylic acid, 1,2,5-hexanetricarboxylic acid, 1,3-dicarboxyl-2-methylenecarboxylpropane, 1,3-dicarboxyl-2-methyl-2-methylenecarboxylpropane, tetra(methylenecarboxyl) methane, 1,2,7,8-octanetetracarboxylic acid, and anhydrides or esters thereof. Polyols having three or more hydroxyl groups may also be used if it is in a small amount. They include sorbitol, 1,2,3,6-hexanetetol, 1,4-sorbitan, pentaerythritol, dipentaerythritol, tripentaerythritol, sucrose, 1.2.4-butanetriol, glycerol, 2-methylpropanetriol, 2-methyl-1,2,4-butanetriol, trimethylolethane. trimethylolpropane, 1,3,5-trihydroxymethylbenzene, erythro-1,2,3-butanetriol, and threo-1,2,3-butanetriol.

In the toner used in the present invention, other resins may also be added besides the polyester resin comprised of the above component materials, in a proportion of not more than 30% by weight of said polyester resin and so as for the melt viscosity $\eta'$ measured by an overhead-type flow tester not to become outside the range of from $10^3$ to $10^6$ poise at a temperature within the range of from 120° C. to 150° C., and for the absolute value of the inclination of a graph not to become more than 0.50 ln (poise)/°C. when the natural logarithms $\ln\eta'$ of the melt viscosity at 120° C. and 150° C. are plotted with respect to the temperatures. For example, there may be contained vinyl resins mainly composed of styrene styrene-butadiene resins, silicone resins, polyurethane resins, polyamide resins, epoxy resins, polyvinyl butyral resins, rosin, modified rosins, terpene resins. phenol resins, aliphatic or alicyclic hydrocarbon resins, aromatic petroleum resins, chlorinated paraffin, and paraffin wax.

When the above cross-linked polyester resins has an acid value of from 5 to 60, an organic metal compound containing a metal of two or more valences may be added in a small amount in the step of heat-kneading where the toner is prepared, so that the excessive fusion of toner can be effectively prevented and the disadvantages such as the penetration into the recording medium, the bleed-through, or the bleeding of image because of the spread of fused toner, can be more effectively stopped from being involved.

According to the studies made by the present inventors, apart from the network-structure forming component in the component materials of the polyester resin, a "weak cross-linked structure", can be brought in the toner by metal ions, so that there can be only a very little increase in the consumption of the power required for the fixing. However, in the present invention, the above effect attributable to the organic metal compound containing a metal of two or more valences, can be attained when the polyester resin contains the aromatic components in a large amount and the polyester resin has an acid value of from 5 to 60. In such instances, the metal compound can be added in a smaller amount, thus resulting in no concurrence of the disadvantages such as an increase in power consumption and a lowering of moisture resistance of the toner.

Accordingly, the metal compound in the present invention may be added preferably in an amount of from 0.2 to 6% by weight, more preferably from 1 to 5% by weight, based on the polyester resin. An amount less than 0.2% by weight may bring about no substantial effect, and an amount more than 6% by weight may cause an increase in the power consumption for the fixing because of an increase in the heat capacity of the toner itself, as in the case when an inorganic filler is added in a large amount. This may considerably lessen the chargeability of the toner because of the incorporation of the metal compound having a lower specific resistance than that of the polymer, resulting in a lowering of development performance. A lowering of moisture resistance has been similarly recognized.

The organic metal compound which can be used includes organic salts or complexes containing the metal of two or more valences. Effective metal species include polyvalent metals such as Al, Ba, Ca, Cd, Co, Cr, Cu, Fe, Hg, Mg, Mn, Ni, Pb, Sn, Sr, and Zn. The effective organic metal compound includes carboxylates, alcoxylates, organic metal complexes or chelate compounds of the above metals. Examples thereof may preferably include zinc acetate, magnesium acetate, calcium acetate, aluminum acetate, magnesium stearate, calcium stearate, aluminum stearate, aluminum isopropoxide, aluminum acetylacetate, acetylacetonatoiron (II), and chromium 3,5-ditertiarybutyl stearate. In particular, acetylacetone metal complexes, salicylic acid metal salts, or salicylic acid metal complexes are preferred.

An embodiment in which the resin used in the toner comprises polymers or copolymers formed of $\alpha,\beta$-ethylenically unsaturated monomers will be described below.

In the present invention, as the binder resin of the toner is also used a resin comprising a polymer formed of at least one kind of $\alpha,\beta$-ethylenically unsaturated monomer, the binder resin having the physical properties that the melt viscosity is from $10^3$ to $10^6$ poise at a temperature within the range of from 120° C. to 150° C., and an absolute value of the inclination of a graph is not more than 0.50 ln (poise)/°C. when the natural logarithms $\ln\eta'$ of the melt viscosity at 120° C. and 150° C. are plotted with respect to the temperatures.

The $\alpha,\beta$-ethylenically unsaturated monomer that constitutes the main component of the resin can be exemplified by styrene and substitution products thereof such as styrene, $\alpha$-methylstyrene, and p-chlorostyrene; monocarboxylic acids having a double bond or substitution products thereof such as acrylic acid, methyl acrylate, ethyl acrylate, butyl acrylate, dodecyl acrylate, octyl acrylate, phenyl acrylate, methacrylic acid, methyl methacrylate, ethyl methacrylate. butyl methacrylate, octyl methacrylate, acrylonitrile, methacrylonitrile, and acrylamide; dicarboxylic acids having a double bond or substitution products thereof such as maleic acid, butyl maleate, methyl maleate, and dimethyl maleate; vinyl esters such as vinyl chloride, vinyl acetate, and vinyl benzoate; vinyl ketones such as vinyl methyl ketone, and vinyl hexyl ketone; and vinyl ethers such as vinyl methyl ether, vinyl ethyl ether, and vinyl isobutyl ether. Such vinyl monomers are used alone or in combination of two or more kinds.

The above $\alpha,\beta$-ethylenically unsaturated resin may preferably be cross-linked. Compounds having two or more copolymerizable double bonds are used as cross-linking agents. They include, for example, aromatic divinyl compounds such as divinylbenzene, and divinylnaphthalene; carboxylic acid esters having two double bonds, such as ethylene glycol diacrylate, ethylene glycol dimethacrylate, 1,3-butanediol dimethacrylate; divinyl compounds such as divinyl aniline, divinyl ether, divinyl sulfide, and divinyl sulfone; and compounds having three or more vinyl groups. These are used alone or in a mixture.

The cross-linking agents may be used in an amount of from 0.01 to 10% by weight, preferably from 0.05 to 5% by weight, based on the total amount of the $\alpha,\beta$-ethylenically unsaturated monomers. In addition to the above $\alpha,\beta$-ethylenically unsaturated monomers, the following compound may be contained in a proportion less than the content of said resin component. The compound includes, for example, styrene-butadiene resins, silicone resins, polyesters, polyurethanes, polyamides, epoxy resins, polyvinyl butyral resins, rosin, modified rosins, terpene resins, phenol resins, aliphatic or alicyclic hydrocarbon resins, aromatic petroleum resins, chlorinated paraffin, and paraffin wax.

Every sort of release agent may be optionally contained in the toner used in the present invention. For example, polyethylene fluoride, fluorine resins, fluorinated carbon oils, silicone oils, low-molecular polyethylenes, and low-molecular weight polypropylenes may be used, which are added in an amount of from 0.1 to 10% by weight.

When the toner used is used as a magnetic toner containing magnetic fine particles, a material that exhibits magnetism or can be magnetized is mixed as the magnetic fine particles. Such a material includes, for example, metals such as iron, manganese, nickel, cobalt, and chromium; magnetite, hematite, all sorts of ferrites, manganese alloys, and other ferromagnetic alloys. They can be used in the form of fine powder having an average particle diameter of from 0.05 to 5 $\mu$, preferably from 0.05 to 0.5 $\mu$. The magnetic fine particles may be contained in the toner preferably in an amount of from 15 to 70% by weight, more preferably from 25 to 45% by weight, based on the total weight of the magnetic toner.

In the toner used in the present invention, various materials can be added for the purpose of coloring or electrostatic charge control. Such materials include, for example, carbon black, black iron oxide, graphite, Nigrosine, metal complexes of monoazo dyes, ultramarine blue, and all sorts of lakes such as Phthalocyanine Blue, Hanza Yellow, Benzo Yellow and Quinacridone.

Colloidal silica may also be contained in the toner particles as a fluidity improver, in an amount of from 10 to 40% by weight. Of course, this fluidity improver may be added externally to the toner. In such instance, it is added in an amount of from 0.2 to 5% by weight based on the toner weight.

The toner (or capsule toner) used in the heat-fixing method of the present invention, preferably, is a toner (or a capsule toner) showing the maximum value (for example, the temperature corresponding to $T_D$ in FIG. 3) of from 40° C. to 129° C., of the endothermic peak that first appears as a result of the measurement made within the range of from 10° C. to 200° C. using a differential scanning calorimeter (DSC). In particular, more preferred is a toner (or a capsule toner) showing the maximum value of from 55° C. to 100° C.

The temperature at the time the film is peeled from the toner-fixed face is, preferably, higher than the above endothermic temperature. More preferably, the film may preferably be peeled on condition of at least 30° C. higher, more preferably from 40° to 140° C. higher, than the above endothermic temperature.

Figure 3:
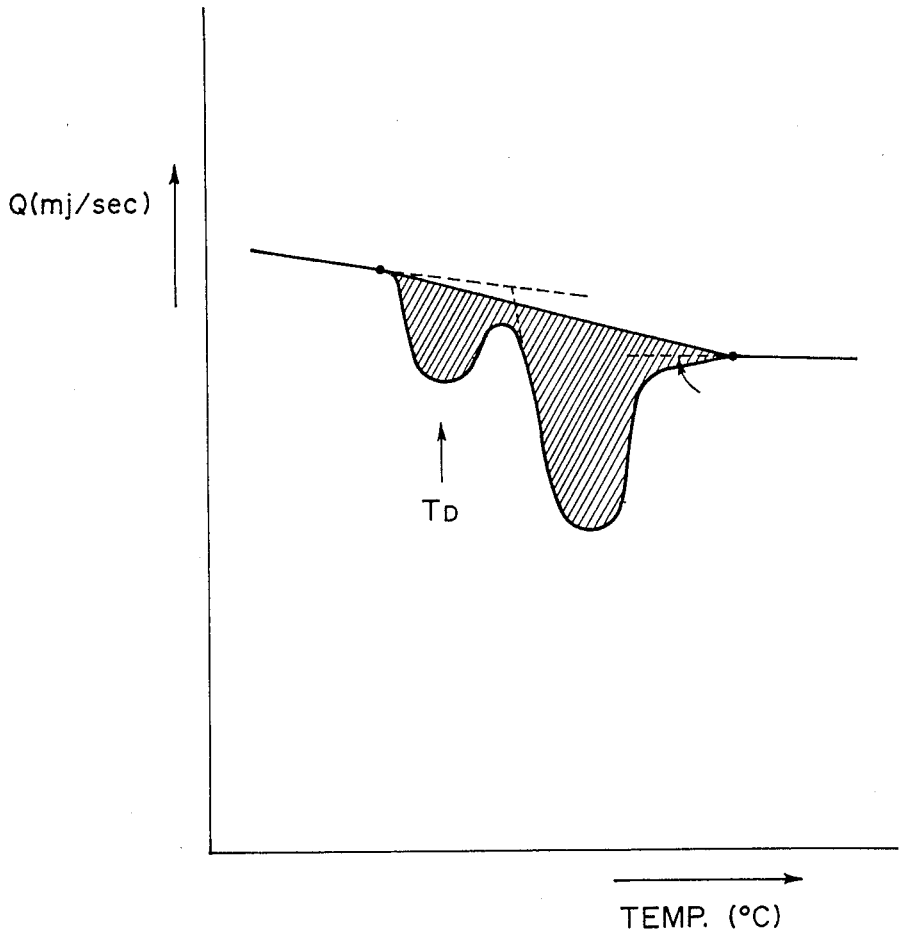
FIG. 3 is a graphic representation of an endothermic peak of toner, measured by differential thermal analysis (using DSC).

As for the method of measuring the maximum value of the endothermic peak as used in the present invention, the value can be calculated according to ASTM D-3418-82. Stated specifically, 10 to 15 mg of the toner is collected, which is then heated in a nitrogen atmosphere at a rate of temperature rise of 10° C./min from room temperature to 200° C., and thereafter the temperature is maintained at 200° C. for 10 minutes, followed by rapid cooling. The toner is thus pre-treated. Thereafter, the temperature is maintained at 10° C. for 10 minutes, and the toner is again heated to 200° C. at a rate of temperature rise of 10° C./min, where the measurement is made. The data as shown in FIG. 3 can be commonly obtained. The maximum value of the endothermic peak which first occurs between room temperature and 200° C. is defined as the endothermic temperature ($T_D$).

The polyester resins and $\alpha,\beta$-ethylenically unsaturated resins as described above can be used as shells for the toner having a capsule structure (i.e., the capsule toner).

In the embodiment in which the toner used in the fixing method of the present invention comprises the capsule toner, the toner takes the form in which its core particles are covered with the resin having the above properties, so that since a material which may inhibit the toner performance can be incorporated into the core particles, the toner can have superior chargeability, fluidity, blocking resistance, and durability. Since the toner particles are covered with the resin having excellent fixing performance and offset resistance, the toner can be very efficiently fixed.

Resin materials used in the core of the capsule toner can be selected from various known resins, which can be used alone or in a mixture or a reaction product of some of these. They can be exemplified by polystyrene, and homopolymers of substitution products thereof; styrene copolymers such as a styrene/acrylate copolymer, a styrene/methacrylate copolymer, a styrene/acrylonitrile copolymer, a styrene/butadiene copolymer, a styrene/isoprene copolymer, and a styrene/acrylonitrile/indene copolymer; acrylic resins, methacrylic resins, silicone resins, polyester resins, furan resins, and epoxy resins.

They further include waxes such as beeswax, carnauba wax, and microcrystalline wax; higher fatty acids such as stearic acid, palmitic acid, and lauric acid; higher fatty acid metal salts such as aluminum stearate, lead stearate, barium stearate, magnesium stearate, zinc stearate, and zinc palmitate; higher fatty acid derivatives such as methylhydroxy stearate, and glycerol monohydroxy stearate; polyolefins such as low-molecular polyethylene, low-molecular polypropylene, polyethylene oxide, polyisobutylene, and polyethylene tetrafluoride; olefin copolymers such as an ethylene/acrylic acid copolymer, an ethylene/acrylate copolymer, an ethylene/methacrylic acid copolymer, an ethylene/methacrylate copolymer, an ethylene/vinyl chloride copolymer, an ethylene/vinyl acetate copolymer, and ionomer resins; rubbers such as isobutylene rubber, nitrile rubber, and chlorinated rubber; polyvinyl pyrrolidone, polyamides, cumaroneindene resin, a methyl vinyl ether/maleic anhydride copolymer, maleic acid modified phenol resin, and phenol modified terpene resin. Among these, the materials can be used alone or in a mixture or a partial reaction product of some of these.

In the present invention, the core of the capsule toner usually contains various kinds of dye or pigment as a colorant. Such a dye or pigment that can be applied includes, for example, carbon black, Nigrosine dyes, lamp black, Sudan Black SM, Fast Yellow G, Benzidine Yellow, Pigment Yellow, Indofast Orange, Irgazine Red, Paranitroaniline Red, Toluidine Red. Carmine FB, Permanet Bordeaux FRR, Pigment Orange R, Lithol Red 2G, Lake Red C, Rhodamine FB, Rhodaminé B Lake, Methyl Violet B Lake, Phthalocyanine Blue, Brilliant Green B, Phthalocyanine Green, Oil Yellow GG, Zapon First Yellow CGG, Kayaset Y 963, Kayaset YG, Sumiplast Yellow GG, Zapon First Orange RR, Oil Scarlet, Sumiplast Orange G. Aurazole Brown B, Zapon First Scarlet CG. Aizen Spiron Red BEH, and Oil Pink OP.

Magnetic powder may also be contained in the core so that the capsule toner can be used as a magnetic capsule toner.

The core of the capsule toner can be obtained by melt-kneading the above components using an apparatus as exemplified by a roll mill, pulverizing the kneaded product using a grinder such as a jet mill, optionally followed by classification using an air classifier. Alternatively, it can be obtained, after the melt kneading, by granulating the kneaded product by spraying, suspension granulation, or electrostatic spraying, optionally followed by classification, so that it can be prepared as fine particles of 20 $\mu$ or less in volume average particle diameter.

Known encapsulation techniques can be utilized for methods of encapsulating these core particles. For example, preferably used are the dry encapsulation in which shells are made fast on the core particle surfaces by the action of mechanical shock, the spray drying, the coacervation, and the phase separation. Besides these, it is also possible to use the in-situ polymerization, and the methods as described in U.S. Pat. Nos. 3,338,991, 3,326,848 and 3,502,582.

A method of making the shells fast on the cores will be described below. It is not preferable for the capsule toner to cause separation of pulverized fragments or walls of cores, or reseparation of walls which have been once adhered even in a trace quantity. Hence, it is preferable for the shell to be surely made fast on the core. It is important that the constitution of a pulverizer is so modified that the dwell time of the powder can be prolonged at the pulverizing step, and an impact is controlled within the range in which pulverization of cores is not caused, and a temperature is controlled within the range in which fusion is not caused. It is effective to use a pulverizer capable of giving impact between a hammer and a liner and having a recycle mechanism (see FIG. 8-1). In making the shells fast on the core, the peripheral speed at the end of a blade or hammer may be from 30 to 130 m/sec, preferably from 30 to 100 m/sec, and the temperature, which is variable depending on the physical properties of the core and wall, may be from 10° C. to 100° C., preferably from 20° C. to 90° C., and more preferably from 30° C. to 70° C. The dwell time of the materials at the part the impact is applied is preferably from 0.2 second to 12 seconds. The machine of the type as shown in FIG. 8-1 has a great latitude since the powder subjected to centrifugal force is gathered in the vicinity of the liner.

The apparatus as shown in FIGS. 8-1 and 8-2 is equipped with a rotating shaft 301, a rotor 302, dispersing blade 303, a rotating member (blade) 304, a partition disc 305, a casing 306, a liner 307, an impact zone 308, an inlet chamber 309, an outlet chamber 310, a return path 311, a product takeout valve 312, a material feeding valve 313, a blower 314, and jacket 315.

More detailed description will be made with reference to FIG. 8-1. The core particles having shell particles on their surfaces are fed from the feeding inlet 313*b*, pass through the inlet chamber 309. pass through the impact zone 308 between the blade 304 and the liner 307, pass through the outlet chamber 310, pass through the return path 311 and blower 314, and then again circulate through the same passage.

In FIG. 8-2, the gap a between the rotating member (blade) 304 and the liner 307 is a minimum gap, and the space corresponding to the width b of the rotating member 304 defines the impact zone.

The gap between the blade or hammer and the liner is preferably from about 0.5 to 5 mm, and more preferably from 1 mm to 3 mm to give good results.

In the capsule toner obtained in the above way, agglomerates of shell particles or deposits of fine core particles and fine shell particles of 5 $\mu$ or less in particle size may be produced, even in a small quantity. Hence, it may sometimes occur that these may cause, beyond tolerance limits, fog or white lines in images or a lowering of image density in the course of repetitive operation for a large number of sheets, depending on the matching of the toner with a photosentive member or copying machine. After the shells have been made fast on the cores, a classification step may further be additionally provided to remove fine powder and coarse powder, so that much better image quality can be obtained. This classification step may be of any of various systems, all of which can be effective. In particular, however, it is possible to use a machine of a centrifugal force classifier type or stationary wall type centrifugal force classifier that employs a rotating blade having a dispersion power. In particular, a classifer having a Coanda block applying the Coanda effect (see U.S. Pat. No. 4,132,634) can give preferable results.

In some instances, the capsule toner may be used as a developer after the mixing (external addition) of a fluidity improver such as colloidal silica, or a lubricant, an abrasive, and a charge controller.

In the fixing method of the present invention, the toner may be formed by suspension polymerization.

This toner is a suspension polymer toner formed by suspension polymerization of a monomer composition to a toner particle size in an aqueous medium, and also has the properties that the melt viscosity of the toner is from $10^3$ to $10^6$ poise at a temperature within the range of from 120° C. to 150° C., and an absolute value of the inclination of a graph in which the logarithms ($\ln\eta'$) of the melt viscosity $\eta'$ at the temperature range of from 120° C. to 150° C. are plotted with respect to the temperature, is not more than 0.50 ln (poise)/°C.

The suspension polymer toner particles used in the present invention can be obtained, for example, by the method as described below, to which, however, the method is by no means limited. A monomer composition obtained by uniformly dissolving or dispersing a polymerizable monomer, a colorant, a polymerization initiator, and further optionally a cross-linking agent, a charge controller, a polar polymer, and other additives, is put into an aqueous phase (i.e., a continuous phase) containing a suspension stabilizer, and granulated with stirring to effect polymerization. Thereafter, the suspension stabilizer is removed, followed by filtration and drying. The toner particles can be thus obtained.

It is particularly preferred to obtain the particles by the suspension polymerization described below, since particles with a sharp particle size distribution ca thereby be obtained.

The polymerizable monomer that can be used for the formation of the suspension polymer toner particles is a monomer having a $CH_2{=}C<$ group as a reactive group. It includes monomers having a reactive double bond as exemplified by styrene and derivatives thereof such as styrene, o-methylstyrene, m-methylstyrene, p-methylstyrene, p-methoxystyrene, and p-ethylstyrene; acrylic acid, methacrylic acid, maleic acid, and maleic acid half ester; $\alpha$-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate. stearyl methacrylate, phenyl methacrylate, dimethylaminoethyl methacrylate, and diethylaminoethyl methacrylate; acrylates such as methyl acrylate, ethyl acrylate, n-butylyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; acrylic acid or methacrylic acid derivatives such as acrylonitrile, methacrylonitrile, and acrylamide. These may be used alone or in combination of two or more kinds. If necessary, a cross-linking agent may be used. The cross-linking agent can be exemplified by divinylbenzene, divinylnaphthalene, diethylene glycol dimethacrylate, and ethylene glycol dimethacrylate. The cross-linking agent may be added usually in an amount of from 0.01 to 10 parts by weight, and preferably from 0.01 to 5 parts by weight, based on 100 parts by weight of the polymerizable monomer.

The polymer of these polymerizable monomers may be added in the monomer composition in a small amount. Suspension polymer toner particles formed from styrene, styrene having a substituent such as an alkyl group, or a monomer mixture of styrene and the other monomer(s). among the above monomers, are preferred when the developing performance and durability are taken into account.

The polymerizable monomers may be polymerized with the addition of a polar polymer having a polar group, a polar copolymer, or a cyclized rubber, so that a preferred polymer toner can be obtained. The polar polymer, polar copolymer, or cyclized rubber may be added in an amount of from 0.5 to 50 parts by weight, and preferably from 1 to 40 parts by weight, based on 100 parts by weight of the polymerizable monomer. An amount thereof less than 0.5 parts by weight makes it difficult for the toner to take a satisfactory quasi-capsule structure. An amount more than 50 parts by weight may result in a shortage of the amount for the polymerizable monomer, increasing a tendency to lower the properties required for the polymer toner. The polymerization may preferably be carried out by suspending the polymerizable monomer composition in which the polar polymer, polar copolymer, or cyclized rubber has been added, in an aqueous phase of an aqueous medium in which a dispersant having a chargeability opposite to the polar polymer has been dispersed. Cationic or anionic polymer, cationic or anionic copolymer, or anionic cyclized rubber contained in the polymerizable monomer composition is electrostatically attracted to reverse-chargeable anionic or cationic dispersant on the surfaces of the particles that form the toner, so that the dispersant covers the particle surfaces. As a result, particles can be prevented from coalescing and made stable, and at the same time the polar polymer, polar copolymer, or cyclized rubber added gathers at the surface layers of the particles that form the toner, thus giving a form like a kind of shell. Hence, the resulting particles are in the form of quasi-capsules. The polar polymer, polar copolymer, or cyclized rubber, which has a relatively high-molecular weight, having gathered at the surface layers of the particles encloses a large number of low-softening compounds in the insides of toner particles, so that properties excellent in the blocking resistance, development performance and wear resistance can be imparted to the polymer particles of the present invention.

The polar polymer (including the polar copolymer and cyclized rubber) and the reverse-chargeable dispersant that are usable in the present invention will be exemplified below. The polar polymer may preferably have a weight average molecular weight, measured by gel permeation chromatography (GPC), of from 5,000 to 500,000, and preferably from 50,000 to 300,000, which is preferably used since such polymer can be well dissolved in the polymerizable monomer and also has durability.

(i) The cationic polymer includes polymers of nitrogen-containing monomers, such as dimethylaminoethyl methacrylate and diethylaminoethyl methacrylate, copolymers of styrene and nitrogen-containing monomers, or copolymers of styrene, unsaturated carboxylates and nitrogen-containing monomers.

(ii) The anionic polymer includes polymers of nitrile monomers, such as acrylonitrile, polymers of halogen monomers, such as vinyl chloride, polymers of unsaturated carboxylic acids, such as acrylic acid, polymers of unsaturated dibasic acids, polymers of anhydrides of unsaturated dibasic acids, or copolymers of styrene and said monomers.

The dispersant may preferably be an inorganic fine powder capable of dispersing and stabilizing the monomer composition particles in the aqueous medium, and slightly soluble in water. The dispersant may be added in the aqueous medium in an amount of from 0.1 to 50% by weight, and preferably from 1 to 20% by weight, based on water.

(iii) The anionic dispersant includes colloidal silica such as Aerosil #2000, #3000 (produced by Nippon Aerosil Co., Ltd.

(iv) The cationic dispersant includes hydrophilic positively chargeable silica fine powders such as aluminum hydroxide, magnesium hydroxide, and aminoalkyl modified colloidal silica formed by coupling-agent treatment.

The anionic cyclized rubber may also be used in place of the above polar polymer or polar copolymer.

Magnetic particles are added in the monomer composition in order to form magnetic suspension polymer toner particles. In this instance, the magnetic particles also serve as the colorant. As the magnetic particles usable in the present invention are used magnetic fine particles having a particle diameter of from 0.05 to 5 μm, and preferably from 0.1 to 1 μm. The magnetic particles may be contained in an amount of from 10 to 60% by weight, and preferably from 20 to 50% by weight, based on the toner weight. These magnetic fine particles may be treated with a treatment such as a silane coupling agent or a titanium coupling agent, or any suitable reactive resin. In this instance, depending on the surface areas of the magnetic fine particles and the density of the hydroxyl groups present on the surfaces, an amount of treatment of not more than 5% by weight, preferably from 0.1 to 3% by weight, can achieve satisfactory dispersibility to the polymerizable monomer and low-softening compound, and does not have deleterious influence on the physical properties of the suspension polymer toner particles. The suspension polymer toner particles contains a colorant, and the colorant which may be used includes well-known dyes, and pigments such as carbon black and grafted carbon black whose particle surfaces are covered with resin. The colorant may be contained in an amount of from 0.5 to 30% by weight based on the monomer or the mixture of the monomer and low-softening compound. A charge controller and a fluidity improver may also be optionally added in the toner.

As to the suspension polymerization, the monomer composition obtained by uniformly dissolving and dispersing the colorant or the additives optionally used is dispersed in the aqueous medium (heated to a temperature at least 5° C. higher, preferably from 10° C. to 30° C. higher, than the polymerization temperature) containing from 0.1 to 50% by weight of the suspension stabilizer (as exemplified by the slightly water-soluble inorganic dispersant), using a homomixer, a homogenizer or the like. The rate and time of stirring and the temperature of the aqueous medium may preferably be oontrolled so as for the particles in the dissolved or softened monomer composition to have the desired toner particle size, usually of not more than 30 μm (e.g., from 0.1 to 20 μm in volume average particle diameter). Thereafter, the liquid temperature of the aqueous medium is dropped to the polymerization temperature while the stirring being carried out to the extent that the particles are prevented from settling so that the dispersed state may substantially be maintained by the action of the dispersion stabilizer. The polymerization may be carried out at a temperature set to not less than 50° C., preferably from 55° to 80° C., and particularly preferably from 60° to 75° C., by the addition of a substantially water-insoluble polymerization initiator with stirring. After completion of the reaction, the toner particles formed are washed, the dispersion stabilizer is removed, and the particles are collected by suitable means such as filtration, decantation or centrifugal separation, followed by drying. The suspension polymer toner particles usable in the present invention are thus obtained. In the suspension polymerization, warter is used as the aqueous medium in an amount of from 200 to 3,000 parts by weight based on 100 parts by weight of the polymerizable monomer or the mixture of the monomer and low-softening compound.

It is preferred that the suspension polymer toner used in the heat-fixing method of the present invention is a toner showing a maximum value of from 40° C. to 129° C., of the endothermic peak that first appears as a result of the measurement made within the measurement range of from 10° C. to 200° C. using a differential scanning calorimeter (DSC). In particular, more preferred is a toner (or a capsule toner) showing a maximum value of from 55° C. to 100° C.

The temperature at the time the film is peeled from the toner-fixed face may preferably be higher than the above endothermic temperature. The film may more preferably be peeled on condition of at least 30° C. higher, and further more preferably be from 40° to 140° C. higher, than the above endothermic temperature.

When the above toner or capsule toner is used in a two-component developer, they are used by mixture with an iron powder carrier, a ferrite carrier, or a coated carrier obtained by coating these with styrene resin, silicone resin, acrylic resin or fluorine resin, or a resinous carrier comprising a magnetic material dispersed in a resin.

An outline of the construction of an example of the image forming apparatus making use of the fixing method of the present inventions will be described below with reference to FIG. 7. The numeral 71 denotes an original-setting table comprising a transparent member such as glass, which reciprocates in the direction of arrow a so that the original is scanned. Right beneath the original-setting table, a short-focus small-diameter image formation device array 72 is provided, and the original placed on the original-setting table is irradiated using an illumination lamp 73. The reflected-light image is brought to slit exposure on a photosensitive drum 74 through the above array 72. The photosentive drum rotates in the direction of arrow b. The numeral 75 denotes a charger, which gives uniform electrostatic charges onto the photosensitive drum 74 covered with, for example, a zinc oxide photosensitive layer or an organic semiconductor photosensitive layer. The drum 74 uniformly electrostatically charged by this charger 75 is image exposed to light through the device array 72, and an electrostatic latent image is thus formed. This electrostatic latent image is made visible using a toner or developer by means of a developing device 76. On the other hand, sheets P received in a cassette S are successively fed onto the drum 74 through a pair of tracking rollers 78 which are rotated with pressure contact in the upper and lower directions, taking the timing so that the feed roller 77 and the image on the photosensitive drum 74 may be synchlonized. The toner image formed on the photosensitive drum 74 is transferred onto the sheet P by a transfer discharger 79. Thereafter, the sheet P separated from the drum 74 by a separating means is led to a fixing unit 81 (shown in FIG. 4A by its enlarged view) through a tracking guide 80, the sheet being subjected to heat fixing method and thereafter delivered onto a tray 82. After the toner image is transferred, the toner remaining on the drum 74 is removed with a cleaner 83.

The present invention employs the method in which the visible image of the toner or capsule toner using the resin having the properties that the melt viscosity is from $10^3$ to $10^6$ poise at a temperature within the range of from 120° C. to 150° C., and an absolute value of the inclination of a graph is not more than 0.50 ln (poise)/°C. when the logarithms ($\ln\eta'$) of the melt viscosity are plotted with respect to the temperatures, is heat-fixed on a recording medium, using the heater element stationarily supported and the pressure member that brings said recording medium into close contact with said heater element through the film interposed between them. Thus, there is provided a fixing method that can fix the toner image to the recording medium in a good state, can obtain a bleeding-free sharp image without not causing the penetration of the toner into the recording medium or the bleed-through, and yet may require only a low power consumption and a very short wating period.

EXAMPLES

The present invention will be more specifically described below by giving Preparation Examples and Examples.

(1) Preparation Example of Polyester Resin A

| | |
|---|---|
| Polyoxypropylene(2,2)-2,2-bis(4-hydroxyphenyl)propane | 23.5 parts by weight |
| Polyoxyethylene(2,2)-2,2-bis(4-hydroxy phenyl)propane | 34.0 parts by weight |
| Terephthalic acid | 19.5 parts by weight |
| n-Dodecenylsuccinic acid | 9.8 parts by weight |
| Trimellitic acid | 13.2 parts by weight |

The above materials in a total amount of 1,500 g were put into a 2 l volume four-necked round flask equipped with a thermometer, a stirrer made of stainless steel, a nitrogen-feeding tube made of glass, and a falling condenser. Subsequently, the flask was placed in a mantle heater, and nitrogen gas was fed from the feeding tube made of glass so that the inside of the reaction vessel was kept an inert atmosphere. Temperature was then raised. Thereafter, 0.10 g of dibutyltin oxide was added, the temperature was maintained at 210° C., and co-condensation reaction was carried out for 12 hours to give polyester resin A.

This polyester resin A showed an apparent viscosity $\eta a'$ at $t_a=120°$ C. and an apparent viscosity $\eta b'$ at $t_b=150°$ C. as measured by the overhead-type flow tester shown in FIG. 1, of $3.8\times10^4$ poise and $2.9\times10^3$ poise, respectively. The absolute value of the inclination of the natural logarithms $\ln\eta'$ of the melt viscosity at 120° C. and 150° C. with respect to the temperature was found to be 0.086 ln (poise)/°C.

(2) Preparation Example of Toner A

Using a twin-screw kneader extruder, 100 parts by weight of the polyester resin A in the above Preparation Example, 60 parts by weight of magnetic powder (magnetic iron oxide), 2 parts by weight of a negative charge controlling agent and 3 parts by weight of a low-molecular weight propylene were melt-kneaded. Thereafter, the kneaded product was cooled and then pulverized using an air-stream pulverizer, followed by classification using an air classifier to give a black fine powder (toner) with a volume average particle diameter of about 12 μm. Based on 100 parts by weight of this black fine powder, 0.4 part by weight of hydrophobic colloidal silica powder was added and mixed to give toner A. This toner A showed $T_D=61°$ C.

Example 1

In the heat-fixing unit of the present invention, as shown in FIG. 4A, the temperature sensor surface temperature $T_1$ of the heater element 11 was set to 200° C.; the power consumption of the resistance material at the heating part, 150 W; the total pressure between the heater element 11 and the pressure roller 18 having an elastic layer formed of silicone rubber, 8 kg; the nip between the pressure roll and film, 3 mm; and the rotational speed of the fixing film 15, 150 mm/sec.

As the heat-resistant sheet, a polyimide film of 20 μm thick, having at the contact face with a recording medium a low-resistance release layer comprising a conductive material dispersed in PTFE was used. At this time, it took about 3 seconds until the temperature sensor surface temperature $T_1$ of the heater element reached 200° C. The temperature $T_2$ was 185° C., and the temperature $T_3$ was 182° C.

Evaluation was made in the following way: Using a modified machine obtained by detaching a fixing unit from a commercially available copying machine NP-270RE, manufactured by Canon Inc., an unfixed image of toner A was obtained. As recording medium, commercially available Canon New Dry Paper (available from Canon Sales, Co., Inc.; 54 g/m$^2$) for use in copying machines was used. The resulting unfixed image of toner A was fixed using the above fixing unit to give a fixed image.

For fixing performance tests on the fixed image, unfixed images on 200 sheets were successively papered through the fixing unit to give fixed images, and the 1st, 10th, 50th, 100th and 200th sheets were each rubbed with Silbon paper under application of a load of 50 g/cm$^2$. The fixing performance was expressed by the rate (%) of a lowering of image density. For offset resistance tests, the unfixed images were successively fixed, and evaluation was made on how many sheets were papered until the fixed image or fixing film became stained.

As a result, the fixing performance was almost constant at the initial stage and the 200th sheet in 200 sheet papering, showing that it was as good as 1 to 3%.

As to the offset resistance, almost no adhesion of toner on the surfaces of the fixing film 15 and pressure roller iB was seen even after 10,000 sheet papering. The resulting images were free from bleeding or bleed-through and were in good quality.

Comparative Example 1

Using the toner A prepared in Example 1, and also using a modified machine of NP-270RE, manufactured by Canon Inc., mounted with a heat-roller fixing unit from which the cleaning mechanism of the fixing roller was detached and also in which the fixing speed was so set as to be 150 mm/sec like that in Example 1, the fixing tests were carried out by successively papering 200 sheets. The fixing performance was within the tolerance of practical use, but was from 7 to 9%, showing a certain inferiority to Example 1.

In the offset resistance tests, stain appeared on the fixing roller after 5,000 sheet papering, showing apparent inferiority.

On the other hand, the waiting period (time) was 30 seconds, which was 10 times that in Example 1.

(3) Preparation Example of Polyester Resin B

| | |
|---|---|
| Polyoxypropylene(2,2)-2,2-bis(4-hydroxyphenyl)propane | 30 parts by weight |
| Polyoxyethylene(2,2)-2,2-bis(4-hydroxy phenyl)propane | 35.0 parts by weight |
| Terephthalic acid | 21.5 parts by weight |
| n-Dodecenylsuccinic acid | 8.0 parts by weight |
| Trimellitic acid | 5.5 parts by weight |

Polyester B was obtained in the same manner as polyester A except for using the above materials. This polyester resin B showed an apparent viscosity $\eta a'$ at $t_a = 120°$ C. and an apparent viscosity $\eta b'$ at $t_b = 150°$ C. as measured by the overhead-type flow tester shown in FIG. 1, of $1.4 \times 10^5$ poise and $2.0 \times 10^3$ poise, respectively. The absolute value of the inclination of the natural logarithms $\ln\eta'$ of the melt viscosity at 120° C. and 150° C. with respect to the temperature was found to be 0.14 ln (poise)/°C.

(4) Preparation Example of Toner B

Toner B was obtained in the same manner as toner A except that 100 parts by weight of the above polyester B was used in place of polyester A. This toner showed $T_D = 59°$ C.

Example 2

Fixing tests and offset resistance tests were carried out in the same manner as in Example 1 except that the temperature sensor surface temperature $T_1$ of the heater element 11 was set to 190° C.; and the rotational speed of the fixing film, 270 mm/sec. The fixing performance was as good as 1 to 3%. The offset resistance also showed good results up to 10,000 sheet papering.

The waiting time of the fixing unit was about 3 seconds similarly as in Example 1. Here, the temperature $T_2$ was 170° C., and the temperature $T_3$ was 168° C.

The resulting images were free from bleeding or bleed-through and were in good quality.

Comparative Example 2

Using the toner (toner B) prepared in Example 2, and also using a modified machine of a NP-6650 type (fixing speed: 270 mm/sec), manufactured by Canon Inc., mounted with a heat-roller fixing unit from which the cleaning mechanism of the fixing roller was detached the fixing tests were carried out by successively papering 200 sheets. The fixing performance was within the tolerance of practical use, but was from 5 to 8%, showing a certain inferiority to Example 2.

However, the power consumption of the heat roller mounted was 820 W. This is a result from the consumption of an electric power about 5.5 times that of the fixing unit of Example 2. In the offset resistance tests, the upper roller began to be stained at 100th sheet papering, and the transferring paper serving as the recording medium wrapped around the upper roller at 250th sheet papering, resulting in the stop of the machine.

Preparation Example of Polyester Resin C

| | |
|---|---|
| Polyoxypropylene(2,2)-2,2-bis(4-hydroxy phenyl)propane | 23.5 parts by weight |
| Polyoxyethylene(2,2)-2,2-bis(4-hydroxy phenyl)propane | 34.0 parts by weight |
| Terephthalic acid | 19.5 parts by weight |
| n-Dodecenylsuccinic acid | 9.8 parts by weight |
| Pyromellitic acid | 13.2 parts by weight |

The above materials in a total amount of 1,500 g were put into a 2 l volume four-necked round flask equipped with a thermometer, a stirrer made of stainless steel, a nitrogen-feeding tube made of glass, and a falling condenser. Subsequently, the flask was placed in a mantle heater, and nitrogen gas was fed from the feeding tube made of glass so that the inside of the reaction vessel was kept an inert atmosphere. Temperature was then raised. Thereafter, 0.10 g of dibutyltin oxide was added, the temperature was maintained at 210° C., and co-condensation reaction was carried out for 12 hours to give a polyester resin. This resin showed an acid value of 16.5.

Preparation Example of Toner C

Using a twin-screw kneader extruder, 100 parts by weight of the polyester resin C in the above Preparation Example, 60 parts by weight of magnetic powder (magnetic iron oxide), 2 parts by weight of an organic metal complex (a chromium complex of 3,5-ditertiarybutylsalicylic acid) and 4 parts by weight of a low-molecular weight polyethylene were melt-kneaded (kneading temperature: 150° C.). Thereafter, the kneaded product was cooled and then pulverized using an air-stream pulverizer, followed by classification using an air classifier to give a black fine powder (toner) with an average particle diameter of about 12 μm.

Using a pressure molding device, 15 g of this black fine powder was molded. The resulting molded product showed an apparent viscosity $\eta a'$ at $t_a=120°$ C. and an apparent viscosity $\eta b'$ at $t_b=150°$ C. as measured by the overhead-type flow tester shown in FIG. 1, of $4.8\times10^5$ poise and $1.9\times10^4$ poise, respectively. The absolute value of the inclination of the natural logarithms $\ln\eta'$ of this apparent viscosity with respect to the temperature was found to be 0.11 ln (poise)/°C.

Subsequently, based on 100 parts by weight of this black fine powder, 0.4 part by weight of hydrophobic colloidal silica powder was added and mixed to give toner C. This toner C showed $T_D=65°$ C.

Example 3

In the heat-fixing unit of the present invention, as shown in FIG. 4A, the temperature sensor surface temperature $T_1$ of the heater element 11 was set to 200° C.; the power consumption of the resistance material at the heating part, 150 W; the total pressure between the heater element 11 and the pressure roller 18, 13 kg; the nip between the pressure roll and film, 3 mm; and the rotational speed of the fixing film 15, 150 mm/sec.

As the heat-resistant sheet, a polyimide film of 20 μm thick, having at the contact face with a recording medium a low-resistance release layer comprising a conductive material dispersed in PTFE was used. At this time, it took about 3 seconds until the temperature sensor surface temperature $T_1$ of the heater element reached 200° C. The temperature $T_2$ was 183° C., and the temperature $T_3$ was 180° C.

Evaluation was made in the following way: Using a modified machine obtained by detaching a fixing unit from a commercially available copying machine NP-270RE, manufactured by Canon Inc., an unfixed image of toner C was obtained. As recording medium, commercially available Canon New Dry Paper (available from Canon Sales, Co., Inc.; 54 g/m$^2$) for use in copying machines was used. The resulting unfixed image of toner C was fixed using the above fixing unit to give a fixed image.

For fixing performance tests on the fixed image, unfixed images on 200 sheets were successively papered through the fixing unit to give fixed images, and the 1st, 10th, 50th, 100th and 200th sheets were each rubbed with Silbon paper under application of a load of 50 g/cm$^2$. The fixing performance was expressed by the rate (%) of a lowering of image density. For offset resistance tests, the unfixed images were successively fixed, and evaluation was made on how many sheets were papered until the fixed image or fixing film became stained.

As a result, the fixing performance was almost constant at the initial stage and the 200th sheet in 200 sheet papering, showing that it was as good as 1 to 3%.

As to the offset resistance, almost no adhesion of toner on the surfaces of the fixing film 15 and pressure roller 18 was seen even after 10,000 sheet papering. The resulting images were free from bleeding or bleed-through and were in good quality.

Comparative Example 3

Using the toner C prepared in Example 3, and also using a modified machine of NP-270RE, manufactured by Canon Inc., mounted with a heat-roller fixing unit from which the cleaning mechanism of the fixing roller was detached and also in which the fixing speed was so set as to be 150 mm/sec like that in Example 1, the fixing tests were carried out by successively papering 200 sheets. The fixing performance was within the tolerance of practical use, but was from 7 to 9%, showing a certain inferiority to Example 3.

In the offset resistance tests, stain appeared on the fixing roller after 5,000 sheet papering, showing apparent inferiority.

On the other hand, the waiting time was 30 seconds, which was 10 times that in Example 3.

Preparation Example of polyester Resin D

| | |
|---|---|
| PolyoxypropYlene(2,2)-2,2-bis(4-hydroxy phenyl)propane | 30 parts by weight |
| Polyoxyethylene(2,2)-2,2-bis(4-hydroxy phenyl)propane | 35.0 parts by weight |
| Terephthalic acid | 21.5 parts by weight |
| n-Dodecenylsuccinic acid | 8.0 parts by weight |
| Pyromellitic acid | 5.5 parts by weight |

Polyester D was obtained in the same manner as polyester C except for using the above materials. This resin showed an acid value of 21.5.

Preparation Example of Toner D

Using a twin-screw kneader extruder, 100 parts by weight of the polyester resin D in the above Preparation Example, 60 parts by weight of magnetic powder (magnetic iron oxide), and 3 parts by weight of an organic metal compound (acetylacetone iron) were melt-kneaded (kneading temperature, 150° C.). Thereafter, the kneaded product was cooled and then pulverized using an air-stream pulverizer, followed by classification using an air classifier to give a black fine powder (toner) with an average particle diameter of about 12 μm.

Using a pressure molding device, 15 g of this black fine powder was molded. The resulting molded product showed an apparent viscosity $\eta a'$ at $t_a=120°$ C. and an apparent viscosity $\eta b'$ at $t_b=150°$ C. as measured by the overhead-type flow tester shown in FIG. 1, of $2.2\times10^5$ poise and $6.5\times10^3$ poise, respectively. The absolute value of the inclination of the natural logarithms $\ln\eta'$ of this apparent viscosity with respect to the temperature was found to be 0.12 ln (poise)°C.

Subsequently, based on 100 parts by weight of this black fine powder, 0.4 part by weight of hydrophobic colloidal silica powder was added and mixed to give toner D. This toner D showed $T_D=73°$ C.

Example 4

Fixing tests and offset resiStance tests were carried out in the same manner as in Example 3 except that the temperature sensor surface temperature $T_1$ of the heater element 11 was set to 190° C.; and the rotational speed of the fixing film, 270 mm/sec. The fixing performance was as good as 1 to 3%. The offset resistance also showed good results up to 10,000 sheet papering.

The waiting time of the fixing unit was about 3 seconds similarly as in Example 3. Here, the temperature $T_2$ was 168° C., and the temperature $T_3$ was 165° C.

The resulting images were free from bleeding or bleed-through and were in good quality.

Comparative Example 4

Using toner D prepared in Example 4, and also using a modified machine of a NP-6650 type (fixing speed 270 mm/sec), manufactured by Canon Inc., mounted with a heat-roller fixing unit from which the cleaning mechanism of the fixing roller was detached, the fixing tests were carried out by successively papering 200 sheets. The fixing performance was within the tolerance of practical use, but was from 5 to 8%, showing a certain inferiority to Example 4.

However, the power consumption of the heat roller mounted was 820 W. This is a result from the consumption of an electric power about 5.5 times that of the fixing unit of Example 4. In the offset resistance tests, the upper roller began to be stained at 100th sheet papering, and the transferring paper serving as the recording medium wrapped around the upper roller at 250th sheet papering, resulting in the stop of the machine.

Preparation Example of Polyester Resin E

| | |
|---|---|
| Polyoxypropylene(2,2)-2,2-bis(4-hydroxy phenyl)propane | 23.5 parts by weight |
| Polyoxyethylene(2,2)-2,2-bis(4-hydroxy phenyl)propane | 34.0 parts by weight |
| Terephthalic acid | 22.2 parts by weight |
| n-Dodecenylsuccinic acid | 9.8 parts by weight |
| Trimellitic acid | 10.5 parts by weight |

The above materials in a total amount of 1,500 g were put into a 2 l volume four-necked round flask equipped with a thermometer, a stirrer made of stainless steel, a nitrogen-feeding tube made of glass, and a falling condenser. Subsequently, the flask was placed in a mantle heater, and nitrogen gas was fed from the feeding tube made of glass so that the inside of the reaction vessel was kept an inert atmosphere. Temperature was then raised. Thereafter, 10 g of dibutyltin oxide was added, the temperature was maintained at 210° C., and co-condensation reaction was carried out for 12 hours to give a polyester resin.

This polyester resin showed an apparent viscosity $\eta a'$ at $t_a=120°$ C. and an apparent viscosity $\eta b'$ at $t_b=150°$ C. as measured by the overhead-type flow tester shown in FIG. 1, of $2.0\times10^4$ poise and $1.1\times10^3$ poise, respectively. The absolute value of the inclination of the natural logarithms $\ln\eta'$ of this apparent viscosity with respect to the temperature was found to be 0.097 ln (poise)/°C.

Preparation Example of Polyester Resin F

| | |
|---|---|
| Polyoxypropylene(2,2)-2,2-bis(4 hydroxy phenyl)propane | 30 parts by weight |
| Polyoxyethylene 2,2)-2,2-bis(4-hydroxy phenyl)propane | 35.0 parts by weight |
| Terephthalic acid | 21.9 parts by weight |
| n-Dodecenylsuccinic acid | 8.0 parts by weight |
| Trimellitic acid | 5.1 parts by weight |

Polyester resin F was obtained in the same manner a polyester resin E except for using the above materials. This polyester resin showed an apparent viscosity $\eta a'$ at $t_a=120°$ C. and an apparent viscosity $\eta b'$ at $t_b=150°$ C. as measured by the overhead-type flow tester shown in FIG. 1, of $1.6\times10^5$ poise and $1.0\times10^3$ poise, respectively. The absolute value of the inclination of the natural logarithms $\ln\eta'$ of this apparent viscosity with respect to the temperature was found to be 0.17 ln (poise)/°C.

Capsule Toner E

| | |
|---|---|
| Polyethylene | 100 parts by weight |
| Magnetite | 65 parts by weight |

The above components were melt-kneaded using a roll mill. After cooling, the kneaded product was coarsely pulverized with a cutter mill, and further finely pulverized using a jet mill. Next, the resulting fine powder was classified using an air classifier to give core particles with a volume average particle diameter of 10.2 μm. In a solution prepared by dissolving and dispersing 20 parts by weight of polyester resin E and 300 parts by weight of THF, 100 parts by weight of the above core particles were dispersed.

Subsequently, the resulting dispersion was subjected to encapsulation using a spray dryer. In 100 parts by weight of capsule toner E thus obtained, 0.5 part by weight of colloidal silica was externally added and mixed to give capsule toner E having colloidal silica on its particle surfaces.

Capsule Toner F

Using the same core particles as those for capsule toner E and also using polyester resin F, encapsulation was carried out in the same manner as in capsule toner E.

Based on 100 parts by weight of capsule toner E obtained here, 0.4 part by weight of colloidal silica was externally added and mixed to give capsule toner F having colloidal silica on its particle surfaces.

Capsule Toner G

| | |
|---|---|
| Polyethylene | 100 parts by weight |
| Irgazine Red | 4 parts by weight |

The above components were kneaded, pulverized and classified in the same manner as in capsule toner E to give core particles with a volume average particle diameter of 10.3 μm.

Subsequently, using the shell resin (polyester resin E) for the capsule toner E, encapsulation was carried out in the same manner, except that the shell resin was used in an amount of 22 parts by weight based on 100 parts by weight of the core particles.

Based on 100 parts by weight of capsule toner G obtained here, 0.4 part by weight of colloidal silica was externally added and mixed to give capsule toner G having colloidal silica on its particle surfaces.

Based on 10 parts by weight of capsule toner G, 100 parts by weight of a resin-coated ferrite carrier was mixed to give a two-component developer.

Next, fixing tests were carried out using capsule toners E, F and G and the heat-fixing unit as shown in FIG. 4A. Blocking resistance tests also were further carried out.

Example 5

In the heat-fixing unit as shown in FIG. 4A, the surface temperature of the heater element 11 was set to 170° C.; the power consumption of the resistance material at the heating part, 150 W; the total pressure of the pressure roller, 7 kg; the nip between the pressure roll and film, 3 mm; and the fixing speed (p.s.), 100 mm/sec. As the heat-resistant sheet, a polyimide film of 20 μm thick, having at the contact face with a recording medium a low-resistance release layer comprising a conductive material dispersed in PTFE was used.

At this time, it took about 1.5 seconds until the surface temperature of the heater element reached 170° C.

Capsule toner E was applied to a modified machine obtained by detaching a fixing unit from a commercially available copying machine Canon NP-270RE (manufactured by Canon Inc.), and an unfixed image was obtained.

This unfixed image was subjected to fixing tests under conditions as in the above, using an external fixing unit as shown in FIG. 4A.

As transferring medium, commercially available Canon New Dry Paper (available from Canon Sales, Co., Inc.; 54 g/m$^2$) was used.

For fixing tests, the solid areas of 20 mm in diameter in the resulting fixed image were rubbed with Silbon paper under application of a load of 50 g/cm$^2$. The fixing performance was expressed by the rate (%) of a lowering of image density. A Macbeth reflection densitometer was used in the measurement of the image density. For further examination on offset resistance, the unfixed images taken from the modified machine were successively passed through the external fixing tester to make judgement on whether or not the fixing film and the opposed roller were stained, whether or not the images were struck through because of offsetting, whether or not the images on the transferring medium were stained, and whether or not the back side of the transferring medium was stained.

As a result, the fixing performance was almost constant at the initial stage and after the 200 sheet papering, showing that it was as good as 1 to 5% (2.0% in average). As to the offset resistance, no stain not only on the transferring paper but also on the back side of the transferring paper was seen at all even after 10,000 sheet papering of unfixed images. After the continuous sheet papering, the surfaces of the film and opposed roller of te fixing unit were further observed to find that there was little adhesion of toner.

In addition, 10 g of this toner put in a 100 cc cup made of polypropylene was allowed to stand for 24 hours in an oven made to have an inside temperature of 45° C. (constant to examine blocking resistance. As a result, no formation of toner mass was observed, showing a good state.

Comparative Example 5

For the comparison of the present heat-fixing unit with the heat roller fixing unit, the following tests were tried. An external fixing unit used for heat-roller fixing was made ready for use. This heat roller fixing unit is comprised of two rollers of an upper roller and a lower roller. The surface of the upper roller comprises Teflon, end a heater is provided at the center thereof. Silicone rubber is used in the lower roller. The nip width was 3 mm. The total pressure between the rollers was set to be 7 kg.

A heater with a power consumption of 150 W was fitted to the center of the heat roller (upper roller), and the temperature was raised while the rolls were rotated. However, even after 5 minutes, the surface temperature was raised only to 160° C., and thus it was impossible to carry out the fixing tests. Then, the heater was replaced with a heater of 900 W power consumption so that it became possible for the surface temperature of the fixing roller to be maintained at 170° C. or more. At this time, it took 23 seconds until the surface temperature of the heat roller was raised from room temperature to reach 170° C. and it further took a little more time in order for the temperature to be maintained to a constant degree as a result of temperature control. This means that a very large power consumption is required in the heat roll fixing and the waiting time can not be eliminated.

Fixing tests were carried out using this heat roll external fixing tester provided with the 900 W heater and in the state that an oil application mechanism of the fixing roller and a cleaning mechanism thereof were detached. The fixing was carried out at a speed of 100 mm/sec, which was the same speed as that in Example 5.

As a result, the fixing performance was from 3 to 10% (4.4% in average) as the rate of the lowering of density at the initial stage and after 200 sheet papering, which was a result poorer than that in Example 5. When 200 sheets were papered, blank areas caused by the offset phenomenon were already seen on the image, and when 2,200 sheets were papered, stain appeared on the back side of the transferring paper. After the continuous papering, the roller surfaces were observed with the finding of adhesion of toner in a considerable quantity.

Example 6

Fixing tests in Example 5 were repeated except for changing the fixing speed to 150 mm/sec. The surface temperature of the heater element, however, was set to be 175° C. At this time, it took about 1.6 seconds until the surface temperature of the heater element reached 175° C. Results of the fixing tests are shown in Table 1. As Table 1 shows, good results were obtained.

Comparative Example 6

Using the external fixing tester comprised of the heat roll, used in Comparative Example 5, the fixing speed was changed to 150 mm/sec and the roller surface temperature was set to 175° C. in order to make comparison with Example 6. At this time, it took about 25 seconds plus a little time until the roller surface temperature reached 175° C.

Results obtained are shown in Table 1. As Table 1 shows, poor results were seen in the fixing performance and offset resistance.

Example 7

Using capsule toner F, fixing tests and blocking tests of toner were carried out in the same manner as in comparative Example 5. Test conditions and test results are shown together in Table 1.

Comparative Example 7

Using capsule toner F, fixing tests were carried out in the same manner as in Comparative Example 5. Test conditions and test results are shown together in Table 1.

Example 8

Using capsule toner G, fixing tests and blocking tests of toner were carried out in the same manner as in Example 5. Test conditions and test results are shown together in Table 1.

Comparative Example 8

Using capsule toner G, fixing tests were carried out in the same manner as in Comparative Example 5. Test conditions and test results are shown together in Table 1.

Table 2 shows the endothermic temperature ($T_D$) measured with DSC, of the capsule toner samples shown in Examples of the present invention, and the heater element temperature ($T_1$), film surface temperature ($T_2$), and film surface temperature at the time of peeling ($T_3$).

TABLE 1

| | | | Test Results | | | | | | | | | |
|---|---|---|---|---|---|---|---|---|---|---|---|---|
| | | | Heat-fixing unit of the present invention (with 150 W heater) | | | | | Heat-roller fixing unit (with 900 W heater) | | | | |
| Capsule toner sample | Blocking resistance at 45° C. | Unfixed image producing machine | Set temp. (°C.) | Temp. rise time (sec) | Fixing speed (mm/sec) | Rub resistance (%) | Occurrence of offset (sheet) | Set temp. (°C.) | Temp. rise time (sec) | Fixing speed (mm/sec) | Rub resistance (%) | Occurrence of offset (sheet) |
| Example: 5 E | Good | NP270RE | 170 | 1.5 | 100 | 2.0 | 10,000(A) | — | — | — | — | — |
| Comp. Ex.: 5 E | Poor | " | — | — | — | — | — | 170 | 23 | 100 | 4.4 | 2,200(B) |
| Example: 6 E | Good | " | 175 | 1.6 | 150 | 2.3 | 10,000(A) | — | — | — | — | — |
| Comp. Ex.: 6 E | Poor | " | — | — | — | — | — | 175 | 25 | 150 | 4.6 | 2,050(B) |
| Example: 7 F | Good | " | 165 | 1.5 | 100 | 2.7 | 10,000(A) | — | — | — | — | — |
| Comp. Ex.: 7 F | Poor | " | — | — | — | — | — | 165 | 21.5 | 100 | 4.6 | 2,100(B) |
| Example: 8 G | Good | NP6650 | 160 | 1.5 | 100 | 2.5 | 10,000(A) | — | — | — | — | — |
| Comp. Ex.: 8 G | Poor | " | — | — | — | — | — | 160 | 20 | 100 | 4.8 | 1,900(B) |

(A): Good;
(B): Back-side stain occurred

TABLE 2

| Example | Capsule toner sample | Endothermic temperature of toner $T_D$ (°C.) | Fixing unit temperature (°C.) $T_1$ | $T_2$ | $T_3$ |
|---|---|---|---|---|---|
| 5 | E | 69 | 170 | 150 | 148 |
| 6 | E | 69 | 175 | 150 | 147 |
| 7 | F | 67 | 165 | 146 | 144 |
| 8 | G | 64 | 160 | 139 | 136 |

$T_1$ Heater element temperature
$T_2$ Film surface temperature
$T_3$ Film surface temperature at the time of peeling

Preparation Example of Polyester Resin Powder

| | |
|---|---|
| Polyoxypropylene(2,2)-2,2-bis(4-hydroxyphenyl)propane | 23.5 parts by weight |
| Polyoxyethylene(2,2)-2,2-bis(4-hydroxy phenyl)propane | 34.0 parts by weight |
| Terephthalic acid | 19.5 parts by weight |
| n-Dodecenylsuccinic acid | 9.8 parts by weight |
| Pyromellitic acid | 13.2 parts by weight |

The above materials in a total amount of 1,500 g were put into a 2 l volume four-necked round flask equipped with a thermometer, a stirrer made of stainless steel, a nitrogen-feeding tube made of glass, and a falling condenser. Subsequently, the flask was placed in a mantle heater, and nitrogen gas was fed from the feeding tube made of glass so that the inside of the reaction vessel was kept an inert atmosphere. Temperature was then raised. Thereafter, 0.10 g of dibutyltin oxide was added, the temperature was maintained at 210° C., and co-condensation reaction was carried out for 12 hours to give a polyester resin.

This resin showed an acid value of 16.5.

In 100 parts by weight of the above resin, 4 parts by weight of a chromium complex of 3,5-ditertiarybutylsalicylic acid was further mixed, and the mixture was melt-kneaded using a roll mill. The kneaded product was cooled and then pulverized, followed by classification using an air classifier to give polyester resin powder G used for the shell, with an average particle diameter of 1.0 μm. This resin powder G showed an apparent viscosity $\eta a'$ at $t_a = 120°$ C. and an apparent viscosity $\eta b'$ at $t_b = 150°$ C. as measured by the overhead-type flow tester shown in FIG. 1, of $4.8 \times 10^5$ poise and $1.9 \times 10^4$ poise, respectively. The absolute value of the inclination $\tan\theta$ of the natural logarithms $\ln\eta'$ of this apparent viscosity with respect to the temperature was found to be 0.11 ln (poise)/°C.

Preparation Example of Polyester Resin Powder H

| | |
|---|---|
| Polyoxypropylene(2,2)-2,2-bis(4-hydroxy- | 30 parts by weight |

-continued

| | |
|---|---|
| pheny)propane | |
| Polyoxyethylene(2,2)-2,2-bis(4-hydroxy-phenyl)propane | 35.0 parts by weight |
| Terephthalic acid | 21.5 parts by weight |
| n-Dodecenylsuccinic acid | 8.0 parts by weight |
| Pyromellitic acid | 5.5 parts by weight |

A polyester resin was obtained in the same manner as polyester resin powder G except for using the above materials This resin showed an acid value of 21.5.

In 100 parts by weight of the above resin, 2 parts by weight of a chromium complex of 3,5-ditertiarybutylsalicyclic acid was further mixed, and the mixture was melt-kneaded using a roll mill. The kneaded product was cooled and then pulverized, followed by classification using an air classifier to give polyester resin powder H used for the shell, with an average particle diameter of 1.0 μm.

This resin powder H showed an apparent viscosity $\eta a'$ at $t_a=120°$ C. and an apparent viscosity $\eta b'$ at $t_b=150°$ C. as measured by the overhead-type flow tester shown in FIG. 1, of $2.2\times10^5$ poise and $6.5\times10^3$ poise, respectively. The absolute value of the inclination $\tan\theta$ of the natural logarithms $\ln\eta'$ of this apparent viscosity with respect to the temperature was found to be 0.12 ln (poise)/°C.

Capsule Toner H

| | |
|---|---|
| Polyethylene | 100 parts by weight |
| Magnetite | 60 parts by weight |

The above components were melt-kneaded using a roll mill. After cooling, the kneaded product was coarsely pulverized with a cutter mill, and further finely pulverized using a jet mill. Next, the resulting fine powder was classified using an air classifier to give core particles with a volume average particle diameter of 10.1 μm.

Based on 100 parts by weight of the above core particles, 35 parts by weight of polyester resin powder G was mixed. Subsequently, using the dry capsule apparatus as shown in FIG. 8-1, encapsulation was carried out under conditions of a circulation time of 5 minutes, a stirring blade peripheral speed of 60 m/sec, an atmospheric temperature of 40° C., and a minimum gap of 2.5 mm.

In 100 parts by weight of capsule toner G thus obtained, 0.5 part by weight of colloidal silica was externally added and mixed to give capsule toner H having colloidal silica on its particle surfaces.

Capsule Toner I

Using polyester resin powder H, and also using the same core particles as those for capsule toner H, encapsulation was carried out in the same manner. Based on 100 parts by weight of capsule toner I thus obtained, 0.6 part by weight of colloidal silica was externally added and mixed to give capsule toner I having colloidal silica on its particle surfaces.

Capsule Toner J

| | |
|---|---|
| Polyethylene | 100 parts by weight |
| Pigment Blue | 5 parts by weight |

The above components were kneaded, pulverized and classified in the same manner as in capsule toner H to give core particles with a volume average particle diameter of 10.3 μm.

Subsequently, using polyester resin powder used for the the shell of capsule toner H, encapsulation was carried out in the same manner.

Based on 100 parts by weight of capsule toner J obtained here, 0.5 part by weight of colloidal silica was externally added and mixed to give capsule toner J having colloidal silica on its particle surfaces.

Based on 10 parts by weight of capsule toner J, 100 parts by weight of a resin-coated ferrite carrier was mixed to give a two-component developer.

Next, fixing tests were carried out using capsule toners H, I and J and the heat-fixing unit as shown in FIG. 4A. Blocking resistance tests also were further carried out.

Example 9

In the heat-fixing unit as shown in FIG. 4A, the surface temperature of the heater element 11 was set to 170° C.; the power consumption of the resistance material at the heating part, 150 W; the total pressure of the pressure roller, 7 kg; the nip between the pressure roll and film, 3 mm; and the fixing speed (p.s.), 100 mm/sec. As the heat-resistant sheet, a polyimide film of 20 μm thick, having at the contact face with a recording medium a low-resistance release layer comprising a conductive material dispersed in PTFE was used.

At this time, it took about 1.5 seconds until the surface temperature of the heater element reached 170° C.

Capsule toner H was applied to a modified machine obtained by detaching a fixing unit from a commercially available copying machine Canon NP-270RE (manufactured by Canon Inc.), and an unfixed image was obtained.

This unfixed image was subjected to fixing tests under conditions as in the above, using an external fixing unit as shown in FIG. 4A.

As transferring medium, commercially available Canon New Dry Paper (available from Canon Sales, Co., Inc.; 54 g/m$^2$) was used.

For fixing tests, the solid areas of 20 mm in diameter in the resulting fixed image were rubbed with Silbon paper under application of a load of 50 g/cm$^2$. The fixing performance was expressed by the rate (%) of a lowering of image density. A Macbeth reflection densitometer was used in the measurement of the image density. For further examination on offset resistance, the unfixed images taken from the modified machine were successively passed through the external fixing tester to make judgement on whether or not the fixing film and the opposed roller were stained, whether or not the images were struck through because of offsetting, whether or not the images on the transferring medium were stained, and whether or not the back side of the transferring medium was stained.

As a result, the fixing performance was almost constant at the initial stage and after the 200 sheet papering, showing that it was as good as 1 to 5% (2.1% in average). As to the offset resistance, no stain not only on the transferring paper but also on the back side of the transferring paper was seen at all even after 10,000 sheet papering of unfixed images. After the continuous sheet papering, the surfaces of the film and opposed roller of te fixing unit were further observed to find that there was little adhesion of toner.

In addition, 10 g of this toner put in a 100 cc cup made of polypropylene was allowed to stand for 24 hours in an oven made to have an inside temperature of 45° C. (constant) to examine blocking resistance. As a result, no formation of toner mass was observed, showing a good state.

Comparative Example 9

For the comparison of the present heat-fixing unit with the heat roller fixing unit, the following tests were tried. An external fixing unit used for heat-roller fixing was made ready for use. This heat roller fixing unit is comprised of two rollers of an upper roller and a lower roller. The surface of the upper roller comprises Teflon, and a heater is provided at the center thereof. Silicone rubber is used in the lower roller. The nip width was 3 mm. The total pressure between the rollers was set to be 7 kg.

A heater with a power consumption of 150 W was fitted to the center of the heat roller (upper roller), and the temperature was raised while the rolls were rotated. However, even after 5 minutes, the surface temperature was raised only to 160° C., and thus it was impossible to carry out the fixing tests. Then, the heater was replaced with a heater of 900 W power consumption so that it became possible for the surface temperature of the fixing roller to be maintained at 170° C. or more. At this time, it took 23 seconds until the surface temperature of the heat roller was raised from room temperature to reach 170° C., and it further took a little more time in order for the temperature to be maintained to a constant degree as a result of temperature control. This means that a very large power consumption is required in the heat roll fixing and the waiting time can not be eliminated.

Fixing tests were carried out using this heat roll external fixing tester provided with the 900 W heater and in the state that an oil application mechanism of the fixing roller and a cleaning mechanism thereof were detached. The fixing was carried out at a speed of 100 mm/sec, which was the same speed as that in Example 9.

As a result, the fixing performance was from 2 to 8% (4.3% in average) as the rate of the lowering of density at the initial stage and after 200 sheet papering, which was a result more or less poorer than that in Example 9. When 200 sheets were papered, blank areas caused by the offset phenomenon were already seen on the image, and when 2,400 sheets were papered, stain appeared on the back side of the transferring paper. After the continuous papering, the roller surfaces were observed with the finding of adhesion of toner in a considerable quantity.

Example 10

Fixing tests in Example 9 were repeated except for changing the fixing speed to 150 mm/sec. The surface temperature of the heater element, however, was set to be 180° C. At this time, it took about 1.6 seconds until the surface temperature of the heater element reached 180° C. Results of the fixing tests are shown in Table 3. As Table 3 shows, good results were obtained.

Comparative Example 10

Using the external fixing tester comprised of the heat roll, used in Comparative Example 9, the fixing speed was changed to 150 mm/sec and the roller surface temperature was set to 180° C. in order to make comparison with Example 10. At this time, it took about 27 seconds plus a little time until the roller surface temperature reached 180° C.

Results obtained are shown in Table 3. As Table 3 shows, poor results were seen in the fixing performance and offset resistance.

Example 11

Using capsule toner I, fixing tests and blocking tests of toner were carried out in the same manner as in Example 9. Test conditions and test results are shown in Table 3.

Comparative Example 11

Using capsule toner I, fixing tests were carried out in the same manner as in Comparative Example 9. Test conditions and test results are shown in Table 3.

Example 12

Using capsule toner J, fixing tests and blocking tests of toner were carried out in the same manner as in Example 9. Test conditions and test results are shown in Table 3.

Comparative Example 12

Using capsule toner J, fixing tests were carried out in the same manner as in Comparative Example 9. Test conditions and test results are shown in Table 3.

Table 4 shows the endothermic temperature ($T_D$) measured with DSC. of the toner samples shown in Examples of the present invention, and the heater element temperature (T1), film surface temperature ($T_2$), and film surface temperature at the time of peeling ($T_3$).

TABLE 3

| | | | Test Results: | | | | | | | | | |
|---|---|---|---|---|---|---|---|---|---|---|---|---|
| | | | Heat-fixing unit of the present invention (with 150 W heater) | | | | | Heat-roller fixing unit (with 900 W heater) | | | | |
| Capsule toner Sample | Blocking resistance at 45° C. | Unfixed image producing machine | Set temp. (°C.) | Temp. rise time (sec) | Fixing speed (mm/sec) | Rub resistance (%) | Occurrence of offset (sheet) | Set temp. (°C.) | Temp. rise time (sec) | Fixing speed (mm/sec) | Rub resistance (%) | Occurrence of offset (sheet) |
| Example: 9 H | Good | NP27ORE | 170 | 1.5 | 100 | 2.1 | 10,000(A) | — | — | — | — | — |
| Comp. Ex.: 97 H | Poor | " | — | — | — | — | — | 170 | 23 | 100 | 4.3 | 2,400(B) |
| Example: 10 H | Good | " | 180 | 1.6 | 150 | 2.3 | 10,000(A) | — | — | — | — | — |
| Comp. Ex.: 10 H | Poor | " | — | — | — | — | — | 180 | 27 | 150 | 4.7 | 2,100(B) |
| Example: 11 I | Good | " | 170 | 1.5 | 100 | 2.4 | 10,000(A) | — | — | — | — | — |

TABLE 3-continued

| Capsule toner Sample | Blocking resistance at 45° C. | Unfixed image producing machine | Test Results: Heat-fixing unit of the present invention (with 150 W heater) Set temp. (°C.) | Temp. rise time (sec) | Fixing speed (mm/sec) | Rub resistance (%) | Occurrence of offset (sheet) | Heat-roller fixing unit (with 900 W heater) Set temp. (°C.) | Temp. rise time (sec) | Fixing speed (mm/sec) | Rub resistance (%) | Occurrence of offset (sheet) |
|---|---|---|---|---|---|---|---|---|---|---|---|---|
| Comp. Ex.: 11 I | Poor | " | — | — | — | — | — | 170 | 23 | 100 | 4.4 | 2,000(B) |
| Example: 12 J | Good | " | 160 | 1.5 | 100 | 2.2 | 10,000(A) | — | — | — | — | — |
| Comp. Ex.: 12 J | — | " | — | — | — | — | — | 160 | 20 | 100 | 4.6 | 1,900(B) |

(A): Good;
(B): Back-side stain occurred

TABLE 4

| Example | Capsule toner sample | Endothermic temperature of toner $T_D$ (°C.) | Fixing unit temperature (°C.) $T_1$ | $T_2$ | $T_3$ |
|---|---|---|---|---|---|
| 9 | H | 73 | 170 | 150 | 147 |
| 10 | H | 73 | 180 | 154 | 152 |
| 11 | I | 72 | 170 | 150 | 149 |
| 12 | J | 71 | 160 | 140 | 138 |

$T_1$: Heater element temperature
$T_2$: Film surface temperture
$T_3$: Film surface temperature at the time of peeling Examples of preparing the suspension polymer toner according to the heat-fixing method of the present invention, and examples of the heat-fixing method making use of the toner will be described below.

Preparation Example of Toner K

| | |
|---|---|
| Styrene monomer | 150 parts by weight |
| Ethylhexyl acrylate monomer | 50 parts by weight |
| Styrene/dimethylaminoethyl methacrylate copolymer | 8 parts by weight |

The above components were mixed. Thereafter, 1 part by weight of azobisisobutylonitrile was added in the resulting mixture. A monomer composition was thus prepared. This monomer composition was introduced into an aqueous medium of 2,000 parts by weight of heated ion-exchanged water containing 10 parts by weight of Aerosil #200 (a product of Nippon Aerosil Co., Ltd.), with stirring using a TK homomixer. After they were introduced, the contents were stirred for 25 minutes at 10,000 r.p.m. to effect dispersion and granulation. After replacement of the stirring with paddle stirring, stirring was further continued for 20 hours under heating, and the polymerization was then completed. Thereafter, the reaction mixture was cooled, and washed with a sodium hydroxide solution to remove silica by dissolution, followed by washing with water, dehydration, drying, and classification to form suspension polymer toner particles of 12 μm in volume average particle diameter.

Figure 5:
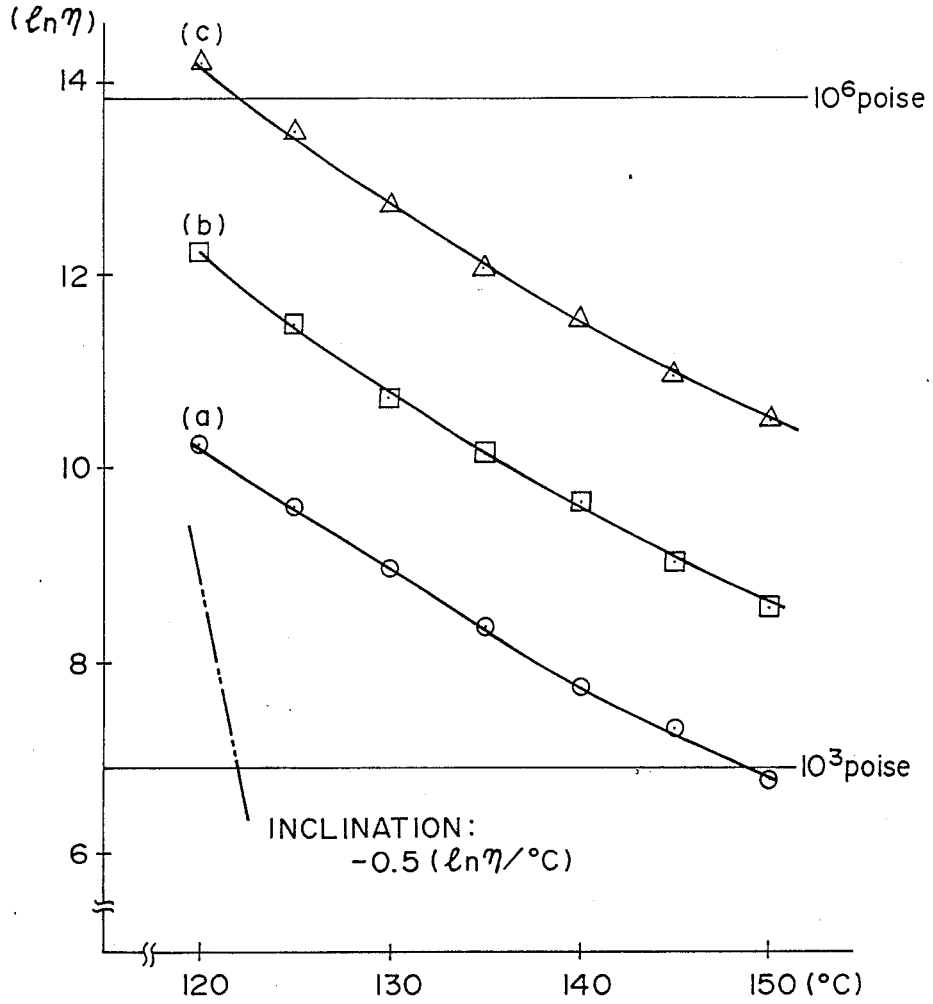
FIG. 5 is an example of the graphic representation to show the melt viscosity characteristics at 120° C. to 150° C. of a suspension polymer toner used in the present invention. The numbers on the ordinate indicate the logarithms $\ln\eta$ of the melt viscosity of binder resin, and those of the abscissa indicate temperature. The two-dot chain line in FIG. 5 shows the inclination −0.50 ln (poise)/°C. of this graph. All binder resins (a) to (c)

Graph (a) in FIG. 5 shows the relationship between the melt viscosity of the toner, and the temperature.

This toner K had the $T_D$ at a temperature of 65° C.

Preparation Example of Toner L

| | |
|---|---|
| Styrene monomer | 120 parts by weight |
| 2-Ethylhexyl acrylate monomer | 50 parts by weight |

-continued

| | |
|---|---|
| Methyl methacrylate monomer | 30 parts by weight |
| Styrene/diemthylaminoethyl methacrylate copolymer | 5 parts by weight |
| Divinylbenzene | 0.3 part by weight |
| Carbon black | 20 parts by weight |

The above components were mixed. Thereafter, 0.8 part by weight of di-tertiarybutyl peroxide was added in the resulting mixture. A monomer composition was thus prepared. Using this monomer composition, suspension polymer toner L was formed in substantially the same manner as in Preparation Example of Toner K.

Graph (b) in FIG. 5 shows the relationship between the viscosity of the toner, and the temperature.

This toner L had the $T_D$ at a temperature of 68° C.

Preparation Example of Toner M

| | |
|---|---|
| Styrene monomer | 150 parts by weight |
| 2-Ethylhexyl acrylate monomer | 40 parts by weight |
| Styrene/dimethylaminoethyl methacrylate copolymer (monomer ratio: 98:2; number average molecular weight: 2 × 104) | 30 parts by weight |
| Divinylbenzene | 0.4 part by weight |
| Carbon black | 20 parts by weight |

The above components were mixed. Thereafter, 0.8 part by weight of di-tertiarybutyl peroxide was added in the resulting mixture. A monomer composition was thus prepared. Using this monomer composition, suspension polymer toner M was formed substantially the same manner as in Preparation Example of Toner K.

Graph (c) in FIG. 5 shows the relationship between the viscosity of the toner M, and the temperature.

This toner M had the $T_D$ at a temperature of 68° C.

Example 13

Suspension polymer toner K (2 parts by weight) and 100 parts by weight of a carrier were mixed to give a two-component developer.

This developer was applied to a modified machine of a commercially available copying machine Canon NP-1215 (manufactured by Canon Inc.), and a recording medium on which toner-unfixed image was formed was obtained therefrom, which was then applied to the fixing unit as shown in FIG. 4A.

In this heat-fixing unit, the temperature sensor surface temperature T1 of the heater element was set to 200° C.; the power consumption of the resistance material at the heating part, 150 W; the total pressure at the pressure roller, 15 kg; the nip between the pressure roll and film, 3 mm; and the fixing speed, 100 mm/sec. As the heat-resistant sheet, a polyimide film of 20 μm thick, having at the contact face with a recording medium a low-resistance release layer comprising a conductive material dispersed in PTFE was used. At this time, it took about 2 seconds until the temperature sensor surface temperature $T_1$ of the heater element reached 200° C. The temperature $T_2$ also at this time was 187° C., and the temperature $T_3$ was 185° C. As recording medium, commercially available Canon New Dry Paper (available from Canon Sales, Co., Inc; 54 g/m$^2$) for use in copying machines was used.

The resulting images were free from penetration of toner into paper and bleed-through, and there were obtained good images also showing good fixing performance and causing no offsetting to the film.

Example 14

Toner L (2 parts by weight) and 100 parts by weight of a carrier were mixed to give a two-component developer.

Using this developer, evaluation was made in the same manner as in Example 13. As a result, good images were obtained, which caused no offset phenomenon, having excellent fixing performance, and also free from penetration of toner into paper, bleed-through, and feathering of images.

The time taken until the temperature sensor surface temperature $T_1$ of the heater element reached 200° C., and the temperatures $T_2$, $T_3$ were substantially the same as those in Example 13.

Example 15

Suspension polymer toner M (2 parts by weight) and 100 parts by weight of a carrier were mixed to give a two-component developer.

This developer was applied to a modified machine of a commercially available copying machine Canon NP-3225 (manufactured by Canon Inc.), and toner-unfixed images were taken out, which was then fixed using the fixing unit as shown in FIG. 4A in the same manner as in Example 13. The resulting images were evaluated.

The resulting images were sharp, free from penetration of toner into recording paper and bleed-through, and also showed good fixing performance. No offsetting to the film was observed.

The time taken until the temperature sensor surface temperature T1 of the heater element reached 200° C., and the temperatures $T_2$, $T_3$ were substantially the same as those in Example 13.

Comparative Example 13

Evaluation was made using the two-component developer in the same manner as in Example 15 except that the fixing unit was detached from the modified commercially available copying machine Canon NP-1215 (manufactured by Canon Inc.) and used as the fixing unit.

This fixing unit is a fixing unit of a heat roll type internally having a heating element of 900 W, and provided with no cleaning member. The evaluation was made by so setting the surface temperature of the heat roll as to be maintained at 160° C.

The images obtained as a result showed poor fixing performance, and also caused the offsetting. The waiting time in this instance was about 60 seconds.

Example 16

Using a twin-screw kneader extruder, 100 parts by weight of a cross-linked polyethylene resin (its melt viscosity characteristics are shown by graph (a) in FIG. 6), 50 parts by weight of magnetite, and 3 parts by weight of Nigrosine dye were melt-kneaded. Thereafter, the kneaded product was cooled and then pulverized using an air-stream pulverizer, followed by classification using an air classifier to give a black fine powder (toner N) with an average particle diameter of about 12 μm. Based on 100 parts by weight of this black fine powder, 0.5 part by weight of commercially available silica powder was added to give toner N having silica powder on its particle surfaces. Toner N showed $T_D$=71° C.

This toner N was applied to a commercially available copying machine Canon NP-1215 (manufactured by Canon Inc.), and a recording medium on which toner-unfixed image was formed was taken out, which was then applied to the fixing unit as shown in FIG. 4A.

In the heat-fixing unit as shown in FIG. 4A, the temperature sensor surface temperature $T_1$ of the heater element was set to 200° C.; the power consumption of the resistance material at the heating part, 150 W; the total pressure at the pressure roller, 15 kg; the nip between the pressure roll and film, 3 mm; and the fixing speed, 100 mm/sec. As the heat-resistant sheet, a polyimide film of 20 μm thick, having at the contact face with a recording medium a low-resistance release layer comprising a conductive material dispersed in PTFE was used. At this time, it took about 2 seconds until the temperature sensor surface temperature T1 of the heater element reached 200° C. The temperature $T_2$ also at this time was 187° C., and the temperature $T_3$ was 185° C. As recording medium, commercially available Canon New Dry Paper (available from Canon Sales, Co., Inc; 54 g/m$^2$) for use in copying machines was used.

The resulting images were free from penetration of toner into paper and bleed-through, and there were obtained good images also showing good fixing performance and causing no offsetting to the film.

Example 17

Using 100 parts by weight of a cross-linked styrene/-butyl acrylate copolymer having its melt viscosity characteristics as shown by graph (d) in FIG. 6, 3 parts by weight of a low-molecular polyethylene, 2 parts by weight of Nigrosin dye, and 4 parts by weight of carbon black, toner O with an average particle diameter of about 14 μm was obtained in the same manner as in Example 16. The $T_D$ of this toner O was 75° C. Based on 100 g of this toner O, 1,000 g of an iron powder carrier was mixed to give a two-component developer.

Using this developer, unfixed toner images were formed using the copying machine NP1215, and evaluation was made in the same manner as in Example 16. As a result, good images were obtained, which caused no offset phenomenon, having excellent fixing performance, and also free from penetration of toner into paper, bleed-through, and feathering of images.

The time taken until the temperature sensor surface temperature $T_1$ of the heater element reached 200° C., and the temperatures $T_2$, $T_3$ were substantially the same as those in Example 16.

Comparative Example 14

Evaluation was made using the two-component developer in the same manner as in Example 17 except that the fixing unit was detached from the commercially available copying machine Canon NP-1215 (manufactured by Canon Inc.) and used as the fixing unit.

This fixing unit is a fixing unit of a heat roll type internally having a heating element of 900 W. The evaluation was made by so setting the surface temperature of the heat roll as to be maintained at 160° C.

The images obtained as a result showed poor fixing performance. The waiting time in this instance was about 60 seconds.

Example 18

Using 100 parts by weight of a mixture of a cross-linked polystyrene resin having its melt viscosity characteristics as shown by graph (b) in FIG. 6 and paraffin wax (mixing ratio: 90:10), and 5 parts by weight of Phthalocyanine Blue, toner P was obtained in the same manner as in Example 17, which toner was further mixed with an iron powder carrier to give a two-component developer. The toner P before it is mixed with the carrier showed $T_D$=68° C. Using this developer, evaluation was made according to Example 17. As a result, no offset phenomenon occurred, and sharp images with good fixing performance were obtained.

The time taken until the temperature sensor surface temperature $T_1$ of the heater element reached 200° C., and the temperatures $T_2$, $T_3$ were substantially the same as those in Example 16.

Capsule Toner Q

| | |
|---|---|
| Polyethylene | 100 parts by weight |
| Magnetite | 60 parts by weight |

The above components were melt-kneaded using a roll mill. After cooling, the kneaded product was coarsely pulverized with a cutter mill, and further finely pulverized using a jet mill. Next, the resulting fine powder was classified using an air classifier to give core particles with a volume average particle diameter of 10.2 μm.

| | |
|---|---|
| (Melt viscosity $\eta' = 3.5 \times 10^3$ poise at 140° C.; absolute value of inclination = 0.14 ln (poise)/°C.) | 100 parts by weight |
| Nigrosine | 2 parts by weight |

The above components were similarly kneaded and pulverized to give a shell resin powder. In a solution prepared by dissolving and dispersing 18 parts by weight of the above shell resin in 300 parts by weight of THF, 100 parts by weight of the above core particles were dispersed.

Subsequently, the resulting dispersion was subjected to encapsulation using a spray dryer. In 100 parts by weight of capsule toner Q thus obtained, 0.5 part by weight of colloidal silica was externally added and mixed to give capsule toner Q having colloidal silica on its particle surfaces.

Capsule Toner R

| | |
|---|---|
| Cross-linked polystyrene resin (Melt viscosity $\eta' = 1.2 \times 10^4$ poise at 130° C.; absolute value of inclination = 0.14 ln (poise)/°C.) | 100 parts by weight |
| Nigrosine | 1.2 parts by weight |

The above components were subjected to the same procedure as in the case of capsule toner Q to give a shell resin powder. Using the above shell resin, encapsulation was carried out in the same manner as in capsule toner Q.

Based on 100 parts by weight of capsule toner R obtained here, 0.4 part by weight of colloidal silica was externally added and mixed to give capsule toner R having colloidal silica on its particle surfaces.

Capsule Toner S

| | |
|---|---|
| Cross-linked styrene/acrylate copolymer (Melt viscosity $\eta' = 2.0 \times 10^5$ poise at 130° C.; absolute value of inclination = 0.17 ln (poise)/°C.) | 100 parts by weight |
| Nigrosine | 1.3 parts by weight |

The above components were subjected to the same procedure as in the case of capsule toner Q to give a shell resin powder.

Subsequently, using the same core particles as in capsule toner Q, encapsulation was carried out in the same manner, except that the shell resin was used in an amount of 22 parts by weight based on 100 parts by weight of the core particles.

Based on 100 parts by weight of capsule toner S obtained here, 0.6 part by weight of colloidal silica was externally added and mixed to give capsule toner S having colloidal silica on its particle surfaces.

Next, fixing tests were carried out using capsule toners Q, R and S and the heat-fixing unit as shown in FIG. 4A. Blocking resistance tests also were carried out.

Example 19

In the heat-fixing unit as shown in FIG. 4A, the surface temperature of the heater element was set to 150° C.; the power consumption of the resistance material at the heating part, 150 W; the total pressure of the pressure roller, 7 kg; the nip between the pressure roll and film, 3 mm; and the fixing speed (p s.), 100 mm/sec. As the heat-resistant sheet, a polyimide film of 20 μm thick, having at the contact face with a recording medium a low-resistance release layer comprising a conductive material dispersed in PTFE was used.

At this time, it took about 1.4 seconds until the surface temperature of the heater element reached 150° C.

Capsule toner Q was applied to a modified machine obtained by detaching a fixing unit from a commercially available copying machine Canon NP-1215 (manufactured by Canon Inc.), and an unfixed image was obtained.

This unfixed image was subjected to fixing tests under conditions as in the above, using an external fixing unit as shown in FIG. 4A.

As transferring medium, commercially available Canon New Dry Paper (available from Canon Sales, Co., Inc.; 54 g/m$^2$) was used.

For fixing tests, the solid areas of 20 mm in diameter in the resulting fixed image were rubbed with Silbon paper under application of a load of 50 g/cm$^2$. The fixing performance was expressed by the rate (%) of a lowering of image density. A Macbeth reflection densitometer was used in the measurement of the image density. For further examination on offset resistance, the unfixed images taken from the modified machine were successively passed through the external fixing tester to make judgement on whether or not the fixing film and the opposed roller were stained, whether or not the images were struck through because of offsetting, whether or not the images on the transferring medium were stained, and whether or not the back side of the transferring medium was stained.

As a result, the fixing performance was almost constant at the initial stage and after the 200 sheet papering, showing that it was as good as 1 to 6% (2.9% in average). As to the offset resistance, no stain not only on the transferring paper but also on the back side of the transferring paper was seen at all even after 10,000 sheet papering of unfixed images. After the continuous sheet papering, the surfaces of the film and opposed roller of the fixing unit were further observed to find that there was little adhesion of toner.

In addition, 10 g of this toner put in a 100 cc cup made of polypropylene was allowed to stand for 24 hours in an oven made to have an inside temperature of 45° C. (constant) to examine blocking resistance. As a result, no formation of toner mass was observed, showing a good state.

Comparative Example 15

For the comparison of the present heat-fixing unit with the heat roller fixing unit, the following tests were tried. An external fixing unit used for heat-roller fixing was made ready for use. This heat roller fixing unit is comprised of two rollers of an upper roller and a lower roller. The surface of the upper roller comprises Teflon, and a heater is provided at the center thereof. Silicone rubber is used in the lower roller. The nip width was 3 mm. The total pressure between the rollers was set to be 7 kg.

A heater with a power consumption of 150 W was fitted to the center of the heat roller (upper roller), and the temperature was raised while the rolls were rotated. However, even after 4 minutes, the surface temperature was raised only to 150° C. Then, the heater was replaced with a heater of 900 W power consumption so that it became possible for the surface temperature of the fixing roller to be maintained at 150° C. or more. At this time, it took 17.5 seconds until the surface temperature of the heat roller was raised from room temperature to reach 150° C., and it further took a little more time in order for the temperature to be maintained to a constant degree as a result of temperature control. This means that a very large power consumption is required in the heat roll fixing and the waiting time can not be eliminated.

Fixing tests were carried out using this heat roll external fixing tester provided with the 900 W heater and in the state that an oil application mechanism of the fixing roller and a cleaning mechanism thereof were detached. The fixing was carried out at a speed of 100 mm/sec, which was the same speed as that in Example 19.

As a result, the fixing performance was from 3 to 10% (5.1% in average) as the rate of the lowering of density at the initial stage and after 200 sheet papering, which was a result poorer than that in Example 19. When 200 sheets were papered, blank areas caused by the offset phenomenon were already seen on the image, and when 1,500 sheets were papered, stain appeared on the back side of the transferring paper. After the continuous papering, the roller surfaces were observed with the finding of adhesion of toner in a considerable quantity.

Example 20

Fixing tests in Example 19 were repeated except for changing the fixing speed to 150 mm/sec. The surface temperature of the heater element, however, was set to be 160° C. At this time, it took about 1.5 seconds until the surface temperature of the heater element reached 160° C. Results of the fixing tests are shown in Table 5. As Table 5 shows, good results were obtained.

Comparative Example 16

Using the external fixing tester comprised of the heat roll, used in Comparative Example 15, the fixing speed was changed to 150 mm/sec and the roller surface temperature was set to 160° C. in order to make comparison with Example 20. At this time, it took about 20 seconds plus a little time until the roller surface temperature reached 160° C.

Results obtained are shown in Table 5. As Table 5 shows, poor results were seen in the fixing performance and offset resistance.

Example 21

Using capsule toner R, fixing tests and blocking tests of toner were carried out in the same manner as in Example 19. Test conditions and test results are shown together in Table 5.

Comparative Example 17

Using capsule toner R, fixing tests were carried out in the same manner as in Comparative Example 15. Test conditions and test results are shown together in Table 5.

Example 22

Using capsule toner S, fixing tests and blocking tests of toner were carried out in the same manner as in Example 19. Test conditions and test results are shown together in Table 5.

Comparative Example 18

Using capsule toner S, fixing tests were carried out in the same manner as in Comparative Example 15. Test conditions and test results are shown together in Table 5.

Table 6 shows the endothermic temperature ($T_D$) measured with DSC, of the capsule toner samples shown in Examples of the present invention, and the heater element temperature ($T_1$), film surface temperature ($T_2$), and film surface temperature at the time of peeling ($T_3$).

TABLE 5

| Capsule toner sample | Blocking resistance at 45° C. | Unfixed image producing machine | Test Results: Heat-fixing unit of the present invention (with 150 W heater) Set temp. (°C.) | Temp. rise time (sec) | Fixing speed (mm/sec) | Rub resistance (%) | Occurrence of offset (sheet) | Heat-roller fixing unit (with 900 W heater) Set temp. (°C.) | Temp. rise time (sec) | Fixing speed (mm/sec) | Rub resistance (%) | Occurrence of offset (sheet) |
|---|---|---|---|---|---|---|---|---|---|---|---|---|
| Example: 19 Q | Good | NP1215 | 150 | 1.4 | 100 | 2.9 | 10,000(A) | — | — | — | — | — |
| Comp. Ex.: 15 Q | Poor | " | — | — | — | — | — | 150 | 17.5 | 100 | 5.1 | 1,500(B) |
| Example: 20 Q | Good | " | 160 | 1.5 | 150 | 2.7 | 10,000(A) | — | — | — | — | — |
| Comp. Ex.: 16 Q | Poor | " | — | — | — | — | — | 160 | 20 | 150 | 4.9 | 1,700(B) |
| Example: 21 R | Good | " | 160 | 1.5 | 100 | 2.4 | 10,000(A) | — | — | — | — | — |
| Comp. Ex.: 17 R | Poor | " | — | — | — | — | — | 160 | 20 | 100 | 4.7 | 1,900(B) |
| Example: 22 S | Good | " | 190 | 1.7 | 100 | 2.5 | 10,000(A) | — | — | — | — | — |
| Comp. Ex.: 18 S | Poor | " | — | — | — | — | — | 190 | 30 | 100 | 4.8 | 2,000(B) |

(A): Good;
(B): Back-side stain occurred

TABLE 6

| Example | Capsule toner sample | Endothermic temperature of toner $T_D$ (°C.) | Fixing unit temperature (°C.) $T_1$ | $T_2$ | $T_3$ |
|---|---|---|---|---|---|
| 19 | Q | 72 | 150 | 130 | 128 |
| 20 | Q | 72 | 160 | 137 | 135 |
| 21 | R | 73 | 160 | 141 | 140 |
| 22 | S | 75 | 190 | 170 | 167 |

$T_1$: Heater element temperature
$T_2$: Film surface temperature
$T_3$: Film surface temparature at the time of peeling

We claim:

1. A method of heat-fixing a visible image of toner to a recording medium, which comprises applying a toner image onto the recording medium, wherein the toner to form said toner image or the resin component of the toner has the properties such that the melt viscosity $\eta'$ measured by an overhead-type flow tester is from $10^3$ to $10^6$ poise at a temperature within the temperature range of from 120° C. to 150° C., and the absolute value of the inclination of a graph is not more than 0.50 ln (poise)/°C. when the natural logarithms $\ln\eta$ of the melt viscosities at 120° C. and 150° C. are plotted with respect to the temperatures; and heat-fixing the toner image retained on the recording medium to the recording medium by use of a heater element as stationarily supported and a pressure member that brings said recording medium into close contact with said heater element through a film interposed between them.

2. A method according to claim 1, wherein said toner has an endothermic peak $T_D$ at a temperature of from 40° to 120° C.

3. A method according to claim 1, wherein said toner has an endothermic peak $T_D$ at a temperature of from 55° to 100° C.

4. A method according to claim 1, wherein said film is peeled from the toner image after the heat-fixing of the toner image, and the surface temperature of said film at the time of being peeled is at least 30° C. higher than the temperature of the endothermic peak $T_D$ of said toner.

5. A method according to claim 4, wherein the surface temperature of said film at the time of being peeled is from 40° to 140° C. higher than the temperature of the endothermic peak $T_D$ of said toner.

6. A method according to claim 1, wherein said toner comprises a binder resin and at least one of a colorant and a magnetic powder.

7. A method according to claim 1, wherein said toner comprises a cross-linked resin.

8. A method according to claim 7, wherein said cross-linked resin comprises a polyester resin or a polymer or copolymer formed from an $\alpha,\beta$-ethylenically unsaturated monomer.

9. A method according to claim 7, wherein said cross-linked resin comprises;

(A) an etherified diphenol;

(B) not less than 30 mol % of an aromatic dicarboxylic acid, based on the total amounts of acids;

(C) from 5 to 40% by weight of at least one of an alkenyl-substituted dicarboxylic acid and an alkyl-substituted dicarboxylic acid, based on the total amount of acids; and (D) at least one of a polycarboxylic acid with three or more carboxylic groups and a polyol with three or more hydroxyl groups.

10. A method according to claim 9, wherein said alkenyl-substituted dicarboxylic acid has an alkenyl group having 6 to 18 carbon atoms.

11. A method according to claim 9, wherein said alkyl-substituted dicarboxylic acid has an alkyl group having 6 to 18 carbon atoms.

12. A method according to claim 8, wherein said cross-linked polyester resin has an acid value of from 5 to 60.

13. A method according to claim 12, wherein said cross-linked polyester resin is melt-kneaded with an organic metal compound containing a metal of two or more valences.

14. A method according to claim 13, wherein said organic metal compound comprises a polyvalent metal selected from the group consisting of Al, Ba, Ca, Cd, Co, Cr, Cu, Fe, Hg, Mg, Mn, Ni, Pb, Sn, Sr and Zn.

15. A method according to claim 14, wherein said organic metal compound comprises a carboxylate, an alkoxylate, an organic metal complex, or a chelate compound.

16. A method according to claim 14, wherein said organic metal compound comprises an acetylacetone metal complex, a salicylic acid metal salt, or a salicylic acid metal complex.

17. A method according to claim 8, wherein said $\alpha,\beta$-ethylenically unsaturated monomer is a vinyl monomer.

18. A method according to claim 8, wherein said cross-linked resin comprises a cross-linked styrene polymer or a cross-linked styrene copolymer.

19. A method according to claim 18, wherein said cross-linked resin comprises a styrene polymer or styrene copolymer cross-linked with divinylbenzene.

20. A method according to claim 1, wherein said heater element has a temperature of from 100° to 300° C.

21. A method according to claim 1, wherein said toner image is heated with a heater element having a temperature of from 100° to 300° C., through a film of from 1 to 100 $\mu$m thick.

22. A method according to claim 21, wherein said film has heat resistance.

23. A method according to claim 22, wherein said film has a layer formed of a polymer selected from the group consisting of a polyimide, a polyester, a polyethylene terephthalate, a tetrafluorothylene/perfluoroalkyl vinyl ether copolymer, a polytetrafluoroethylene, and a polyamide.

24. A method according to claim 22, wherein said film has a layer formed of a metal.

25. A method according to claim 22, wherein said film has at least one of a release layer and a low-resistant layer.

26. A method according to claim 22, wherein said film comprises a layer of a polyimide film and a fluorine resin layer.

27. A method according to claim 26, wherein said fluorine resin layer has a conductive material dispersed therein.

28. A method according to claim 26, wherein said fluorine resin layer comprises a polytetrafluoroethylene.

29. A method according to claim 1, wherein said film is pressed against the heater element by a pressure member under a total pressure of from 4 to 20 kg.

30. A method according to claim 29, wherein said pressure member is provided with a pressure roller having a rubber elastic layer.

31. A method according to claim 30, wherein said pressure member is provided with a pressure roller having an elastic layer formed of a silicone rubber.

32. A method according to claim 1, wherein said heater element is heated by applying an electric current of a pulse-like waveform to a resistor.

33. A method according to claim 1, wherein said heater element has a low heat capacity and is of linear structure.

34. A method according to claim 1, wherein said heater element is provided with a resistance material and a temperature sensor, where, assuming the temperature of said heater element detected by the temperature sensor as $T_1$, the surface temperature $T_2$ of the film opposed to the resistance material is about 10° C. to about 30° C. lower than the temperature $T_1$, and the surface temperature $T_3$ of the film on the part at which said film is peeled from the fixed toner image is substantially equal to the temperature $T_2$.

35. A method according to claim 1, wherein said toner is prepared by melt-kneading a mixture containing at least a binder resin and a colorant or a magnetic powder, cooling and pulverizing the resulting kneaded product, followed by classification.

36. A method according to claim 1, wherein said toner is of capsule structure having a core particle and a shell.

37. A method according to claim 36, wherein said toner is of capsule structure having a core particle and a shell, and the resin that constitutes the shell has the properties such that the melt viscosity $\eta'$ measured by an overhead-type flow tester is from $10^3$ to $10^6$ poise at a temperature within the temperature range of from 120° C. to 150° C., and an absolute value of the inclination of a graph is not more than 0.50 ln (poise)/°C. when the natural logarithms $\ln\eta$ of the melt viscosities at 120° C. and 150° C. are plotted with respect to the temperatures.

38. A method according to claim 1, wherein said toner is a toner prepared by suspension polymerization.

39. A method according to claim 1, wherein said toner has colloidal silica on the toner particle surfaces.

* * * * *

UNITED STATES PATENT AND TRADEMARK OFFICE

CERTIFICATE OF CORRECTION

PATENT NO. : 4,957,774 Page 1 of 3

DATED : September 18, 1990

INVENTOR(S) : Shinji Doi, et al.

It is certified that error appears in the above-identified patent and that said Letters Patent is hereby corrected as shown below:

COLUMN 2:

Line 32, "iS" should read --is--.

Line 54, "toner" should read --a toner--.

COLUMN 7:

Line 17, "$t_b$°°C.," should read --$t_b$°C.,--.

Line 67, "elkyl group" should read --alkyl group--.

COLUMN 8:

Line 9, "napnthalenetricarboxylic acid," should read --naphthalenetricarboxylic acid,-- and, "1,2, 4-napnthalenetricar-" should read --1,2, 4 naphthalenetricar- --.

COLUMN 14:

Line 9, "ca" should read --can--.

Line 46, "monomer(s)." should read --momomer(s),--.

UNITED STATES PATENT AND TRADEMARK OFFICE

CERTIFICATE OF CORRECTION

PATENT NO. : 4,957,774

DATED : September 18, 1990

INVENTOR(S) : Shinji Doi, et al.

It is certified that error appears in the above-identified patent and that said Letters Patent is hereby corrected as shown below:

COLUMN 16:

Line 55, "warter" should read --water--.

COLUMN 19:

Line 31, "roller iB" should read --roller 18--.

COLUMN 23:

Line 53, "10g" should read --0.10g--.

COLUMN 25:

Line 60, "te" should read --the--.

COLUMN 26:

Line 9, "end" should read --and--.

UNITED STATES PATENT AND TRADEMARK OFFICE

CERTIFICATE OF CORRECTION

PATENT NO. : 4,957,774 Page 3 of 3

DATED : September 18, 1990

INVENTOR(S) : Shinji Doi, et al.

It is certified that error appears in the above-identified patent and that said Letters Patent is hereby corrected as shown below:

COLUMN 29:

Line 2, "pheny)propane" should read --phenyl)propane--.

COLUMN 36:

Line 51, "Nigrosin dye," should read --Nigrosine dye,--.

Signed and Sealed this

Fifth Day of May, 1992

*Attest:*

DOUGLAS B. COMER

*Attesting Officer*

*Acting Commissioner of Patents and Trademarks*